US012351419B2

(12) United States Patent
Schwab et al.

(10) Patent No.: US 12,351,419 B2
(45) Date of Patent: Jul. 8, 2025

(54) AUTOMATIC MAGAZINE LOADER FOR SUPPLYING CARTON BLANKS TO CARTON MAGAZINE

(71) Applicant: R.A Jones & Co., Covington, KY (US)

(72) Inventors: Joseph R. Schwab, Cincinnati, OH (US); Richard Dean Rohret, Bettendorf, IA (US); Stephen T. Hill, Bettendorf, IA (US)

(73) Assignee: R.A Jones & Co., Covington, KY (US)

( * ) Notice: Subject to any disclaimer, the term of this patent is extended or adjusted under 35 U.S.C. 154(b) by 254 days.

(21) Appl. No.: 18/246,058

(22) PCT Filed: Nov. 15, 2021

(86) PCT No.: PCT/US2021/059411

§ 371 (c)(1),
(2) Date: Mar. 21, 2023

(87) PCT Pub. No.: WO2022/104225

PCT Pub. Date: May 19, 2022

(65) Prior Publication Data

US 2023/0356968 A1 Nov. 9, 2023

Related U.S. Application Data

(60) Provisional application No. 63/113,355, filed on Nov. 13, 2020.

(51) Int. Cl.

| | |
|---|---|
| ***B65H 5/00*** | (2006.01) |
| ***B65H 1/02*** | (2006.01) |
| ***B65H 1/30*** | (2006.01) |

(52) U.S. Cl.

CPC ..... *B65H 5/006* (2013.01); *B65H 1/025* (2013.01); *B65H 1/30* (2013.01);

(Continued)

(58) Field of Classification Search

CPC ..... B65H 5/006; B65H 2301/4223; B65H 2301/4221; B65H 2301/4222; B65H 2301/4224; B65H 1/30; B65H 1/025

See application file for complete search history.

(56) References Cited

U.S. PATENT DOCUMENTS 5,970,834 A * 10/1999 Garofano ..... B65B 43/145 414/907

2007/0147981 A1 6/2007 Moncrief et al.

FOREIGN PATENT DOCUMENTS

WO 2018009140 A1 1/2018

OTHER PUBLICATIONS

The International Bureau of WIPO, International Preliminary Report On Patentability, International Application No. PCT/US2021/059411, mailed May 25, 2023 (8 pages).

(Continued)

*Primary Examiner* — Jeremy R Severson

(74) *Attorney, Agent, or Firm* — Wood Herron & Evans LLP

(57) ABSTRACT

A carton handling system for a carton blank magazine. The carton handling system includes a carriage assembly with a carton handling tool. The carriage assembly moves the carton handling tool in two axes of motion to receive a slug of carton blanks and to position the slug of carton blanks in the carton blank magazine. The carton handling system further includes a finger carried on the carton handling tool. The carton handling tool is movable to engage the finger with an underside of a fallen carton blank lying at an end of an advancing stack of blanks in the carton blank magazine so as to lift the fallen carton blank against a preceding blank at the end of the advancing stack of blanks. The carton handling tool is also movable to position the slug of carton blanks at an endmost blank in the advancing stack of blanks.

21 Claims, 21 Drawing Sheets

(52) U.S. Cl.
CPC ..... *B65H 2301/4221* (2013.01); *B65H 2301/4222* (2013.01); *B65H 2301/4223* (2013.01); *B65H 2301/42242* (2013.01); *B65H 2555/30* (2013.01); *B65H 2701/176* (2013.01); *B65H 2701/1766* (2013.01); *B65H 2801/81* (2013.01)

(56) References Cited

OTHER PUBLICATIONS

European Patent Office, International Search Report and Written Opinion of the International Searching Authority, International Application No. PCT/US2021/059411, mailed Mar. 2, 2022 (9 pages).

* cited by examiner

AUTOMATIC MAGAZINE LOADER FOR SUPPLYING CARTON BLANKS TO CARTON MAGAZINE

CROSS-REFERENCE TO RELATED APPLICATIONS

The present application is a submission under 35 U.S.C. § 371 of International Application No. PCT/US2021/059411, filed Nov. 15, 2021, which claims the filing benefit of U.S. Provisional Application Ser. No. 63/113,355, filed Nov. 13, 2020, the disclosures of which are incorporated herein by reference in its their entireties.

TECHNICAL FIELD

This invention relates generally to apparatus and methods for feeding a new slug of carton blanks to a carton blank magazine in a cartoning line. More particularly, this invention relates to an automatic apparatus and methods for feeding slugs of carton blanks to a magazine of carton blanks in a cartoning line.

BACKGROUND

Folded carton blanks are frequently delivered to packaging machinery in large quantities (e.g., 50 or more cartons) in an open-top master case or banded bundle. The cartons blanks in these master cases are typically emptied onto a horizontal magazine by either a machine operator or by automated means. The horizontal magazine may be operably disposed in a cartoning line where carton blanks are fed from the magazine to a cartoning machine which feeds or picks the blanks from such a magazine, erects cartons from the blanks, fills and sends the cartons with product and discharges the filled cartons. In any event, when a master case is emptied onto the magazine by a machine operator, the process often involves inverting the master case and dumping the cartons onto a magazine, such as a horizontal magazine, removing the master case, and then patting and adjusting (i.e., "conditioning") the slug of carton blanks by hand to assume a uniform placement that will successfully be fed downstream to a cartoner. Automated methods of magazine loading can vary, but all must duplicate some aspects of the machine operator conditioning of the slug of carton blanks. Improper conditioning of the slug of carton blanks can result in miss-feeds or jams in the cartoner, or with problems on the magazine itself such as a trailing-most carton blank fall back or away from the line of other carton blanks in the horizontal magazine, or carton damage.

Previous automated efforts for placing a slug of carton blanks on horizontal magazines have typically involved placing the rectangular or square-shaped slug of carton blanks in a horizontal magazine by various means and then seeking to condition the group similar to how a machine operator would accomplish the tasks on the magazine. Placing the compressed rectangular or square-shaped slug on the horizontal magazine provided only limited possibilities for achieving a consistent desired shape of the slug of carton blanks on the magazine. Results would include carton group height variation from front to back, excessive gapping between placement groups, top and side carton shingling, trailing-most carton group fall-back, and marring and damage to cartons.

In view of the above, it is desirable to maintain a minimal accumulation of folded flat carton blanks or "prime" of carton blanks in the magazine to accommodate the demand for carton blanks at blank pick or carton erection stations just downstream of the blank magazine. The preferred orientation of carton blanks in the blank magazine is with the upper edges of each carton blank tilted forwardly respective to their lower edges which trail in the feed or machine direction. Thus, a desired shape of a slug of carton blanks being delivered to the magazine is a parallelogram, with the upper edges of each carton blank tilted forwardly respective to their lower edges. To this end, it is preferred to deliver a new slug of flat carton blanks to the last carton blank of the magazine so that the blanks in the slug lean forward, with the first blank in the slug engaging the last blank of the carton stack in the magazine.

When the last blank in a carton magazine is not disposed at the preferred lean angle, or inclination, with the stack, it might be tipped rearwardly so that it lies horizontally on the magazine floor, drive chains the like. When the new slug moves toward the magazine stack, this flat, out-of-position blank or fallen carton blank blocks consistent positioning of fresh blanks in the new slug of blanks and can jam the magazine replenishment operation desired. This could cause a line disruption or stoppage and waste, whether the new slug is machine fed or manually fed.

Accordingly, one aspect of the invention is to provide improved apparatus and methods for replenishing carton blanks in a carton magazine and eliminating difficulties arising from fallen or out-of-position carton blanks at the rear or upstream end of the blanks in a carton blank magazine.

A further aspect of the invention is to provide improved apparatus and methods for automatically replenishing carton blanks in a carton blank magazine while eliminating adverse effects of a fallen or out-of-position blank in the magazine.

SUMMARY

The present invention overcomes the foregoing and other shortcomings and drawbacks of machinery for replenishing carton blanks in a carton magazine. While the present invention will be discussed in connection with certain embodiments, it will be understood that the present invention is not limited to the specific embodiments described herein.

According to one embodiment of the invention, a carton handling system for loading a carton blank magazine with a slug of carton blanks is provided. The carton handling system includes a carriage assembly with a carton handling tool. The carriage assembly is capable of moving the carton handling tool in two axes of motion to receive the slug of carton blanks and to position the slug of carton blanks in the carton blank magazine. The material handling system further includes a finger carried on the carton handling tool. In this regard, the carton handling tool is movable to engage the finger with an underside of a fallen carton blank lying at an end of an advancing stack of blanks in the carton blank magazine so as to lift the fallen carton blank against a preceding blank at the end of the advancing stack of blanks. The carton handling tool is also movable to position the slug of carton blanks at an endmost blank in the advancing stack of blanks. In an aspect of the invention, movement of the carton handling tool to receive the slug of carton blanks is in an upward direction relative to the carton blank magazine.

According to one aspect of the invention, the carton handling tool further includes a first compression jaw and a second compression jaw spaced apart from the first compression jaw along an operative end of the carton handling tool. At least one of the first and second compression jaws is operable to engage and to hold the slug of carton blanks such that the plurality of blanks are held against inclination prior to placement of the slug of carton blanks at the endmost blank in the advancing stack of blanks. In another aspect, the first compression jaw is operatively connected to a slide assembly configured to laterally move the first compression jaw toward or away from the second compression jaw. In one aspect, the first compression jaw is pivotable about the slide. In yet another aspect, the first compression jaw is pivoted in a direction away from the second compression jaw to position each carton blank of the slug of carton blanks at an inclination prior to placement of the slug of carton blanks at the endmost blank in the advancing stack of blanks.

According to yet another aspect of the invention, the second compression jaw is pivotably mounted on the carton handling tool. In one aspect, the first compression jaw and the second compression jaw are each pivoted in a direction toward the carton blank magazine to position each blank of the slug of carton blanks at an inclination prior to placement of the slug of carton blanks at the endmost blank in the advancing stack of blanks.

In one aspect of the invention, the finger is fixed to a front end of the carton handling tool. In another aspect, the finger is fixed to the slide assembly. In yet another aspect, the finger is fixed to the first compression jaw.

According to an aspect of the invention, the carriage includes a first sensor positioned to detect the fallen carton blank at the end of the advancing stack of blanks in the carton blank magazine. In another aspect, the carriage includes a second sensor positioned to detect the endmost blank in the advancing stack of blanks in the carton blank magazine.

According to one aspect of the invention, the carriage is capable of simultaneously moving the carton handling tool along a vertical axis and a horizontal axis relative to the carton blank magazine. In another aspect, the carriage is capable of moving the carton handling tool in a downward direction from the carton blank magazine along the vertical movement axis and in a rearward direction away from the carton blank magazine along the horizontal movement axis to retract the finger from a lifted fallen carton blank.

According to one embodiment of the invention, a method of loading a slug of carton blanks into a carton blank magazine is provided. The method includes providing a carton handling system having a carriage assembly including a carton handling tool. The carriage assembly is capable of moving the carton handling tool in two axes of motion to receive the slug of carton blanks and to position the slug of carton blanks in the carton blank magazine. The carton handling system further includes a finger carried on the carton handling tool and at least one sensor. The method includes receiving the slug of carton blanks by the carton handling tool, moving the slug of carton blanks toward an end of an advancing stack of blanks in the carton blank magazine, and detecting whether a fallen carton blank carton is lying at the end of the advancing stack of blanks. If a fallen carton blank is detected, lifting the fallen carton blank against a preceding blank carton at the end of the advancing stack of blanks with the finger, moving the slug of blanks toward the end of the advancing stack of blanks, and releasing the slug of blanks at the end of the advancing stack of blanks.

According to an aspect of the invention, the method includes moving the carton handling tool downwardly and rearwardly away from the stack of blanks in the carton blank magazine to release the slug of blanks to a position to receive another slug of blanks.

In another aspect of the invention, the method includes moving the carton handling tool rearwardly away from a lifted fallen carton blank and downwardly to a position to move the slug of blanks toward the end of the advancing stack of blanks in the carton blank magazine.

In yet another aspect of the invention, the carton handling tool further includes a first compression jaw and a second compression jaw with the first compression jaw being pivotably mounted on the carton handling tool. The step of moving the slug of blanks toward the end of the advancing stack of blanks further includes pivoting the first compression jaw to position the slug of carton blanks at an inclination prior to placement of the slug of carton blanks at the endmost blank in the advancing stack of blanks.

In another aspect of the invention, the first compression jaw is operatively connected to a slide assembly configured to laterally move the first compression jaw toward and away from the second compression jaw. The step of receiving the slug of carton blanks by the carton handling tool further includes moving the slide assembly to adjust a distance between the first compression jaw and the second compression jaw to receive the slug of carton blanks and moving the slide assembly to compress the slug of carton blanks between the first compression jaw and the second compression jaw.

In yet another aspect of the invention, the step of receiving the slug of carton blanks by the carton handling tool includes moving the carton handling tool in an upward direction relative to the carton blank magazine.

Various additional features and advantages of the invention will become more apparent to those of ordinary skill in the art upon review of the following detailed description of one or more illustrative embodiments taken in conjunction with the accompanying drawings.

BRIEF DESCRIPTION OF THE DRAWINGS

The accompanying drawings, which are incorporated in and constitute a part of this specification, illustrate one or more embodiments of the invention and, together with the general description given above and the detailed description given below, serve to explain the one or more embodiments of the invention.

DETAILED DESCRIPTION

Figure 1:
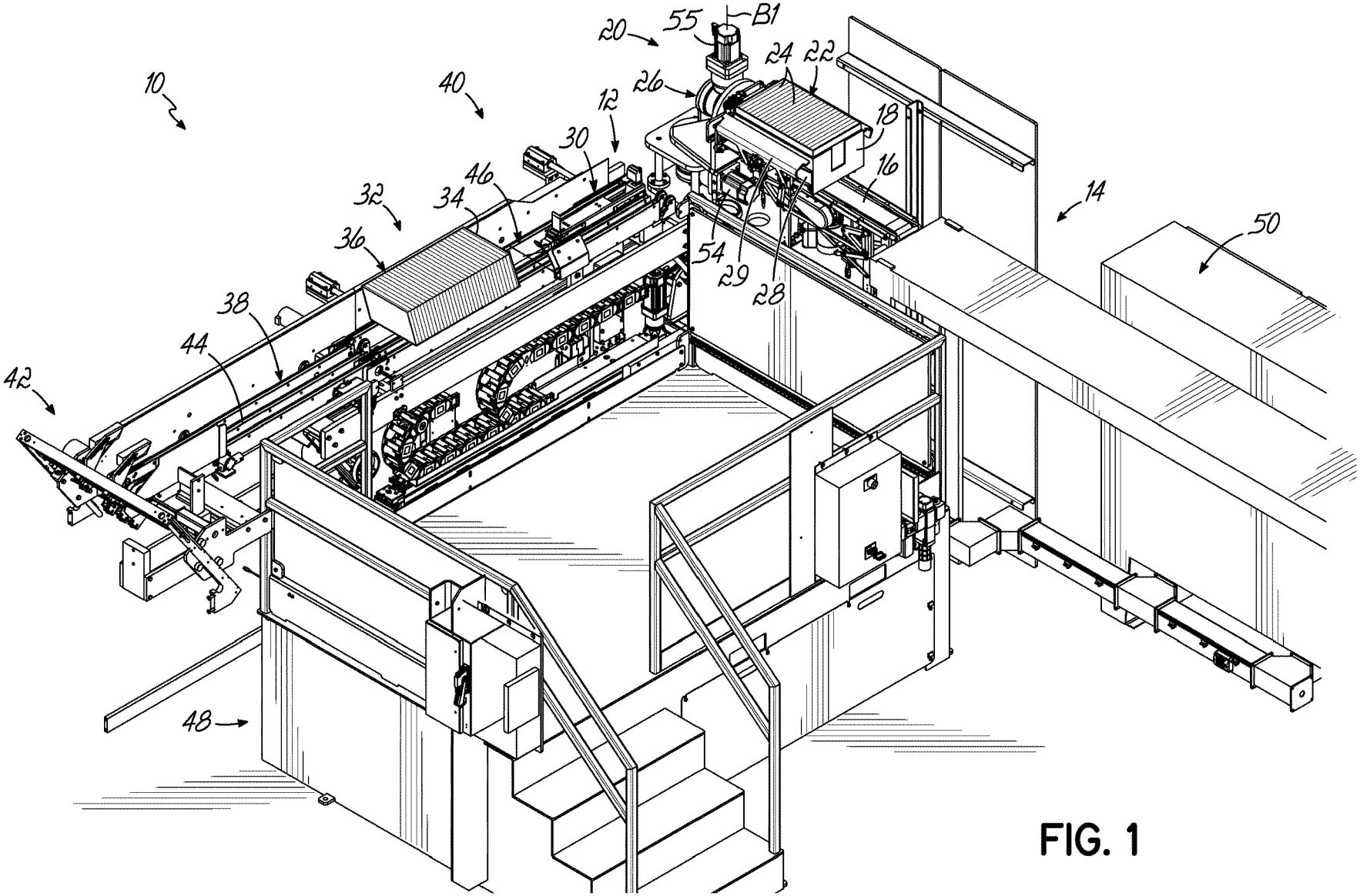
FIG. 1 is a perspective view of an automatic magazine loader system including a linear carton handling system according to exemplary embodiments of the invention.

Aspects of the present invention are directed to a linear carton handling system and process for retrieving a slug of carton blanks, conditioning the slug of carton blanks, and placing the conditioned slug of carton blanks into a horizontal carton magazine for further processing. In this regard, embodiments of the carton handling system, otherwise referred to as a loader, are for use in machinery for automatically loading the horizontal carton magazine with carton blanks. The carton handling system of the present invention may be utilized as a component of an automatic magazine loader (AML) system which may include the material handling device, the carton handling system, the horizontal or extended carton magazine, an empty case conveyor, and an operator platform, for example.

The carton handling system is configured to automatically retrieve and extract a slug of carton blanks from the material handling device and place the slug of carton blanks onto the horizontal magazine at the end of an advancing stack of carton blanks in the magazine. At the same time, the carton handling system is configured to automatically condition the slug of carton blanks to provide the slug of carton blanks with a desired shape, or lean, prior to placing the slug of carton blanks on the horizontal magazine. Prior to placing the slug of carton blanks onto the horizontal magazine, the carton handling system is configured to correct any fallen carton blanks at the end of an advancing stack of carton blanks in the magazine. In this regard, the carton handling system includes a carton blank lifting finger and is configured to detect and upright a fallen carton blank with the finger prior to placing the conditioned slug of carton blanks at the end of the advancing stack of carton blanks in the magazine. Each of these aspects of the invention promote cartoning line efficiency and will be described in turn below.

By conditioning the slug of carton blanks, it is meant that the slug of carton blanks is manipulated, or conditioned, to have a desired parallelogram shape prior to being placed in the horizontal magazine. A conditioned slug of carton blanks will have the upper edges of each carton blank of the slug of carton blanks tilted forwardly respective to their lower edges which trail in the feed or machine direction. The side edges of the cartons are generally aligned to form smooth side surfaces of the slug of carton blanks. The tilt which gives the slug of carton blanks its parallelogram shape may be referred to as lean, inclination, or controlled lean, for example. As will be described in further detail below, controlled lean of the advancing stack of carton blanks in the horizontal magazine is needed so that carton blanks can be fed down a throat of the magazine without jamming or otherwise damaging the carton blanks.

Various carton blanks are depicted in the figures to illustrate aspects of the invention. Other carton blank formats (e.g., size and shape) can be handled by embodiments of the invention, and reference to specific carton blanks herein is not meant to limit the scope of the invention.

Referring now to the figures, FIG. 1 illustrates an exemplary AML system 10 in which a carton handling system 12 according to embodiments of the present invention has particular utility. The AML system 10 includes a case receiving station 14 and an in-feed conveyor 16 configured to receive and convey master cases 18 of carton blanks to a material handling device 20. Each master case 18 includes a slug 22 of folded carton blanks 24 which may comprise 50 or more individual folded carton blanks 24, for example. As shown, the individual carton blanks 24 are stored in a side-by-side arrangement that conforms to the shape of the case 18. Thus, the slug 22 of carton blanks 24 is generally rectangular in shape.

The material handling device 20, sometimes referred to herein as the case flipping station 20, includes a two-axis of motion robotic device 26 having a pair of kinematic arm clamps 28. The robotic material handling device 26 is configured to clamp, invert, and rotate each master case 18 to an accessible position over the carton handling system 12 so that the slug 22 of carton blanks 24 may be retrieved by a carton handling tool 30 of the carton handling system 12. As described in further detail below, the carton handling tool 30 is configured to extend in an upward direction to the inverted master case 18, grip and remove the slug 22 of carton blanks 24 from the master case 18, and gently lower the slug 22 of carton blanks 24 down to a connect horizontal magazine 32. The carton handling tool 30 is configured to place the slug 22 of carton blanks 24 against an endmost carton blank 34 in an advancing stack of cartons 36 in the magazine 32.

As shown in FIG. 1, the horizontal magazine 32 includes a throat 38 which extends between a receiving end 40 and a discharge end 42 of the magazine 32. The magazine 32 includes a conveyor 44 to advance the stack of cartons 36 along the throat 38 and downstream to a cartoner (not shown) for further processing. In this regard, the throat 38 is configured to support the stack of cartons 36, preferably in a controlled lean position, as shown, as the stack of cartons 36 is advanced from the receiving end 40 to the discharge end 42 of the magazine 32 by the conveyor 44. The receiving end 40 is positioned near the case flipping station 20 and includes an envelope 46 in which the carton handling tool 30 is movable. As will be described in further detail below, the carton handling tool 30 is able to move in two axes of motion to receive each slug 22 of carton blanks 24 from the case flipper 20 and to position the slug 22 of carton blanks 24 in the carton blank magazine 32.

For operational efficiency, it is important to maintain a minimal accumulation of carton blanks 24, or "prime" of carton blanks 24, in the magazine 32 to accommodate the downstream demand for carton blanks 24. In this regard, the AML system 10 is configured as an on-demand type system to supply slugs of blank cartons 22 to the receiving end 40 of the magazine 32 as carton blanks 24 are removed from the magazine 32 at the discharge end 42. Strategically located photo-eyes (not shown) provide the magazine control and ensure overall operational reliability. For example, the AML system 10 may include a low level photo-eye and a high level photo-eye. When the low level photo-eye is unblocked by the stack of cartons 36 in the magazine 32, the AML system 10 will continue to position slugs of carton blanks 22 in the horizontal magazine 32 until the high level photo-eye is blocked at which point the AML system 10 magazine 32 loading cycle will stop. As long as the high level photo-eye is blocked, the horizontal magazine 32 cannot receive additional slugs of carton blanks 22. Once the high level photo-eye is unblocked, there is enough space on the magazine 32 to receive additional slugs of carton blanks 22.

To facilitate movement of the stack of cartons 36 along the horizontal magazine 32, it is important to maintain a controlled lean of the stack of cartons 36. Controlled lean ensures that the stack of cartons 36 can be fed down the throat 38 of the magazine 32 without jamming due to excessive gapping between cartons 24, top and side carton shingling, or fall-back of the trailing-most carton group. Controlled lean also prevents marring and damage to cartons 24. In this regard, it is desirable to condition the slug 22 of carton blanks 24 prior to positioning the slug 22 of carton blanks 24 in the magazine 32. That way, when the slug 22 is positioned in the magazine 32, the lean of the advancing stack of cartons 36 in the magazine 32 is maintained. However, inevitably a trailing or endmost carton 34 of the advancing stack of carton blanks 36 may fall down flat on the magazine 32 conveyor 44. This phenomenon may be referred to as fall-back or a fallen carton blank, and it can include one or several fallen carton blanks 24.

Typically, a fallen carton blank 24 requires manual intervention by an operator to fix. This requires the AML system 10 to be stopped so that an operator can manually upright the fallen carton blank 24. This results in unnecessary downtime and added cost. As described in further detail below, embodiments of the carton handling system 12 are configured to both condition each slug 22 of carton blanks 24 prior to positioning the slug 22 of carton blanks 24 in the magazine 32 as well as upright fallen carton blanks 24 in the magazine 32 to eliminate the need for manual intervention and stoppage of the AML system 10.

As shown in FIG. 1, the AML system 10 is assembled around an operator platform 48. The platform 48 allows an operator to interact with components of the AML system 10 to respond to auditory or visual alarms, manually load or prime the magazine 32, tune components such as positioning of the case flipping station 20 and robotic device 26 relative to the carton handling system 12, or otherwise operate the system 10. The platform 48 may be where a Human Machine Interface (HMI) and one or more control cabinets 50 which house appropriate control equipment for components of the AML system 10 are located. To this end, components of the AML system 10, including embodiments of the present invention, are responsive to stored programs for commanding operation of those components. The programs may be computer-readable program instructions for carrying out operations of the embodiments of the present invention. The computer-readable programs may be assembly language, source code, or object code written in any combination of one or more programming languages, and may be implemented using one or more computing devices or systems which may include a processor, a memory, an input/output (I/O) interface, and a Human Machine Interface (HMI), for example.

Figure 2:
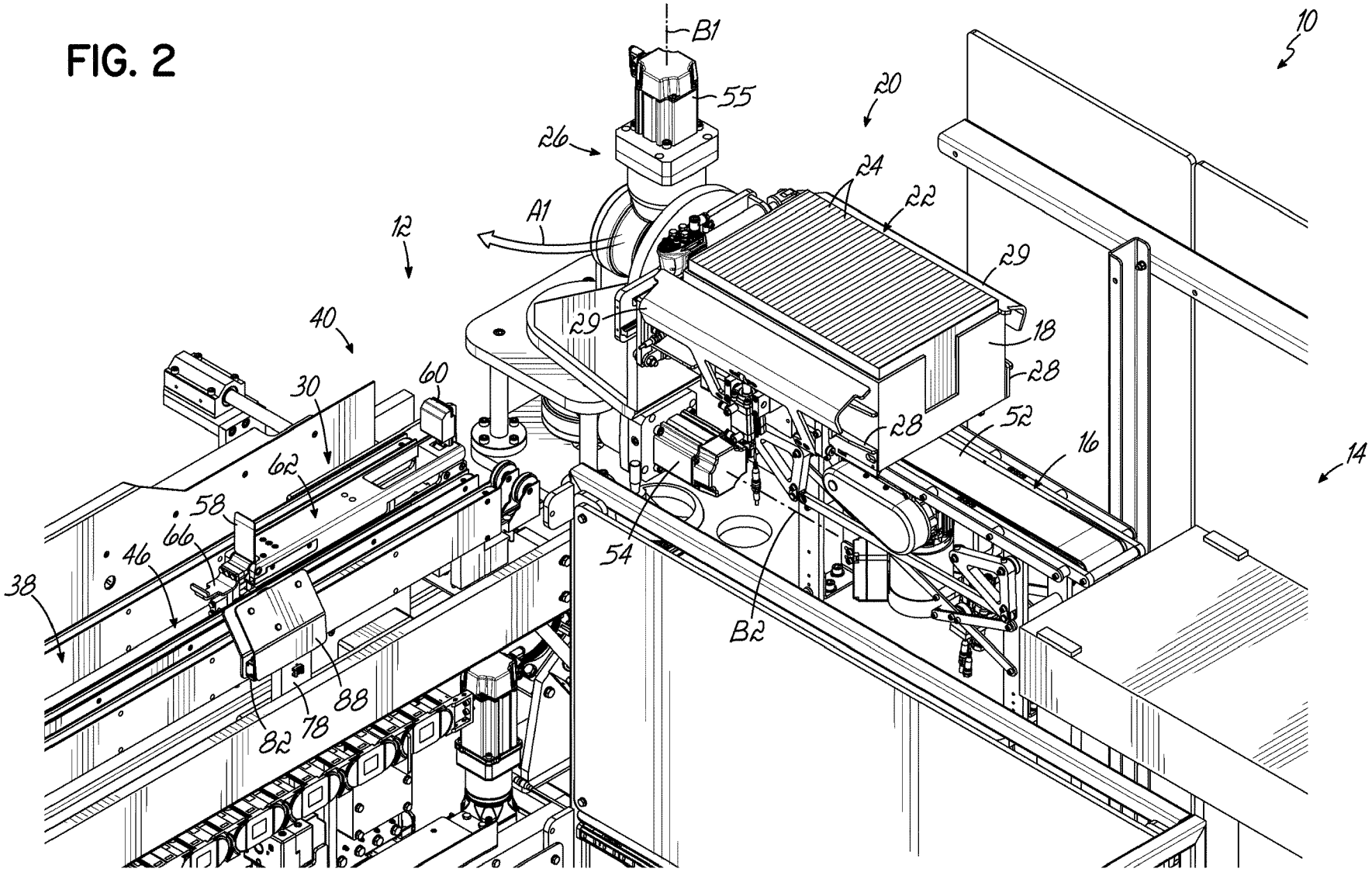
FIG. 2 is a perspective view of a material handling device and the linear carton handling system of FIG. 1.
Figure 3A:
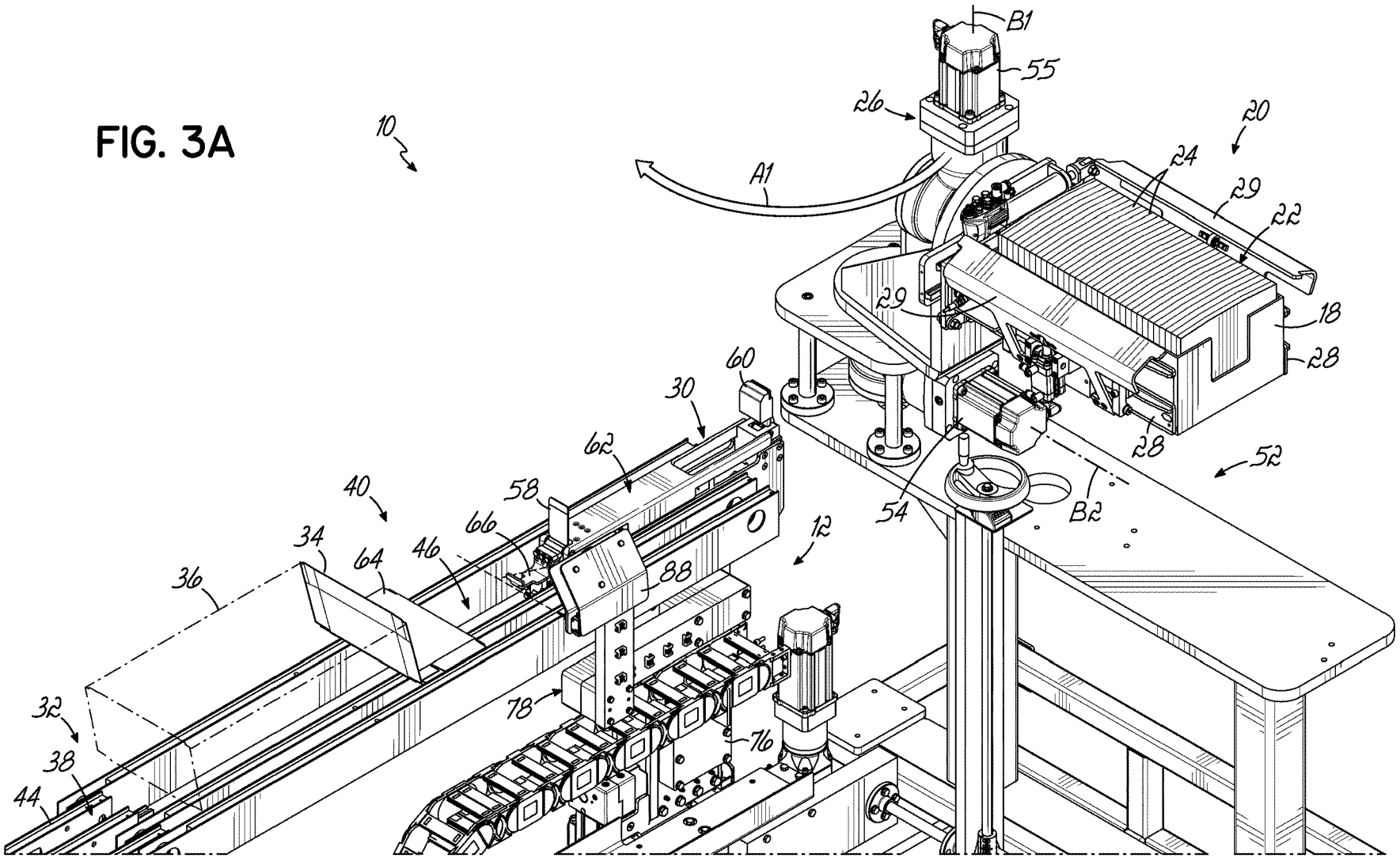
FIGS. 3A and 3B are perspective views of the material handling device and the linear carton handling system of FIG. 2, illustrating movement of a master case of carton blanks by the material handling device.
Figure 3B:
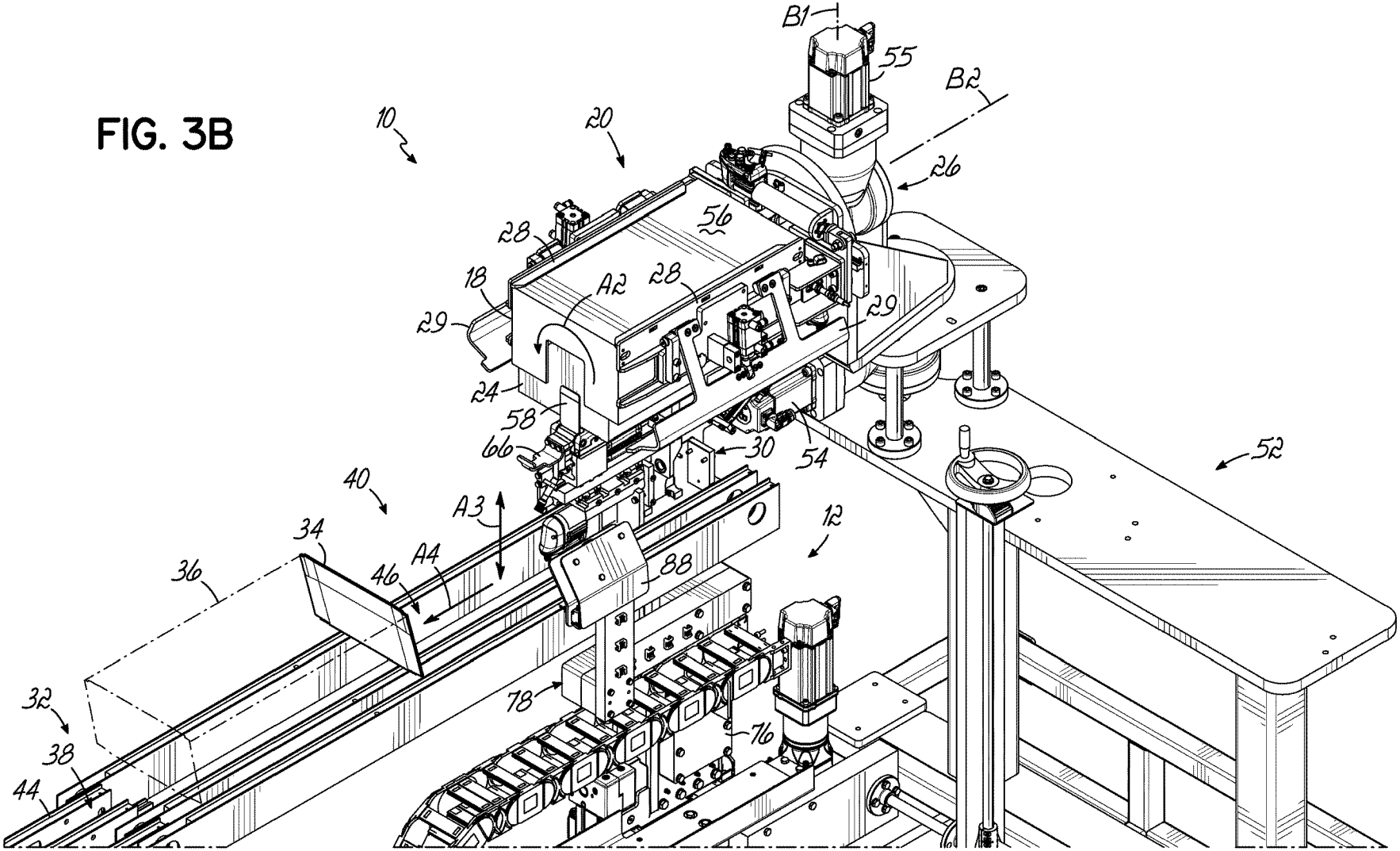

FIGS. 2-3B illustrate details of the case flipping station 20 and the carton handling system 12, and their interactions. As briefly described above, the robotic device 26 of the case flipping station 20 is configured to clamp, invert, and rotate each master case 18 to an accessible position over the carton handling system 12 to be retrieved by the carton handling tool 30. In this regard, one master case 18 is moved via the conveyor 16 from the case receiving station 14 to a receiving zone 52 at the case flipping station 20. Once the master case 18 is positioned within the receiving zone 52, the robotic device 26 is programmed in a known manner to clasp the master case 18 by engaging the pair of kinematic arm clamps 28 with sides of the master case 18 to contain the master case 18 therebetween. The kinematic arm clamps each include a movable cover 29 configured to close over portions of the slug 22 of carton blanks 24 in the master case 18 to contain the slug 22 of carton blanks 24 therein during movement of the master case 18. Thus, while the covers 29 are shown in an opened position, they are closed when the robotic device 26 is moving the master case 18. The robotic device 26 pivots the contained master case 18 about a vertical axis B1 via a motor 54 to position the master case 18 over the carton handling tool 30, as indicated by directional arrow A1. At the same time, the material handing device 26 rotates the master case 18 to invert the case 18 over the carton handling tool 30, as indicated by directional arrows A2, via a second motor 55 which rotates the case 18 about a horizontal axis B2. When so positioned, as shown in FIG. 3B, a base 56 of the master case 18 is facing upward with the slug 22 of carton blanks 24 facing downward and accessible for retrieval by the carton handling tool 30, as described in further detail below.

With reference to FIGS. 3A and 3B, the carton handling tool 30 is movable to retrieve the slug 22 of carton blanks 24 from the inverted master case 18. In this regard, the carton handling tool 30 includes a first compression jaw 58 and a second compression jaw 60 for clamping opposite ends of the slug 22 of carton blanks 24 within the master case 18. The first compression jaw 58 and the second compression jaw 60 are spaced apart along a longitudinal length of an operative end 62 of the carton handling tool 30. As will be described in further detail below, the length of the operative end 62 of the carton handling tool 30 is adjustable to both compress the slug 22 of carton blanks 24 with the first and second jaws 58, 60, and to accommodate for different sized slugs 22 of carton blanks 24, for example. In any event, the first and second compression jaws 58, 60 are operable to engage, compress, and hold the slug 22 of carton blanks 24 such that the plurality of blanks 24 are held against inclination prior to placement of the slug 22 at the endmost blank 34 in the advancing stack of blanks 36.

As shown in FIG. 3B, the carton handling tool 30 moves in an upward direction along a first movement axes, as indicated by directional arrow A3, to retrieve the slug 22 of carton blanks 24 from the master case 18 being held in an inverted position by the material handling device 20. In this regard, the carton handling tool 30 retrieves the slug 22 of carton blanks 24 from the material handling device 20 at a location above the plane of carton blanks 24 moving along the horizontal magazine 32. Before clamping the slug 22 of carton blanks 24, the carton handling tool 30 is configured to tamp the slug 22 of carton blanks 24 with the operative end 62 (FIG. 3A) to ensure that the upper edges and lower edges of each carton blank 24 are aligned. This tamping process is performed while the master case 18 is still held by the material handling device 20, as shown in FIG. 3B. Once the slug 22 of carton blanks 24 has been tamped, the carton handling tool 30 compresses the slug 22 of carton blanks 24 between the first and second compression jaws 58, 60 and removes the slug 22 of carton blanks 24 from the master case 18 by moving in a downward direction along the first movement axis A3. Simultaneously, the robotic device 26 may be configured to open the pair of kinematic arm clamps 28 on the master case 18 to facilitate removal of the slug 22 of carton blanks 24 therefrom. The carton handling tool 30 is movable in a second movement axis, as indicated by directional arrow A4, to place the slug 22 of carton blanks 24 in the carton blank magazine 32. As described in further detail below, the carton handling tool 30 both conditions the slug 22 of carton blanks 24 and uprights a fallen carton blank 64 in the carton blank magazine 32, if detected, with a carton lifting finger 66 prior to placing the slug 22 of carton blanks 24 in the carton blank magazine 32 behind the advancing stack of carton blanks 36.

As briefly described above, the carton handling tool 30 is capable of horizontal movement (e.g., forward and backward movement along an X-axis) in the first axis of motion. The first axis of motion may be considered a first movement direction that includes both forward and backward movement of the carton handling tool 30 in the feed or machine direction. The first axis of motion, or movement direction, is indicated by directional arrow(s) A4 throughout this disclosure. Similarly, the carton handling tool 30 is capable of simultaneous vertical movement (e.g., upward and downward movement along a Y-axis) in the second axis of motion. The second axis of motion may be considered a second movement direction that includes both upward and downward movement of the carton handling tool 30 in a direction perpendicular to the feed or machine direction. The second axis of motion, or movement direction, is indicated by directional arrow(s) A3 throughout this disclosure.

Figure 4:
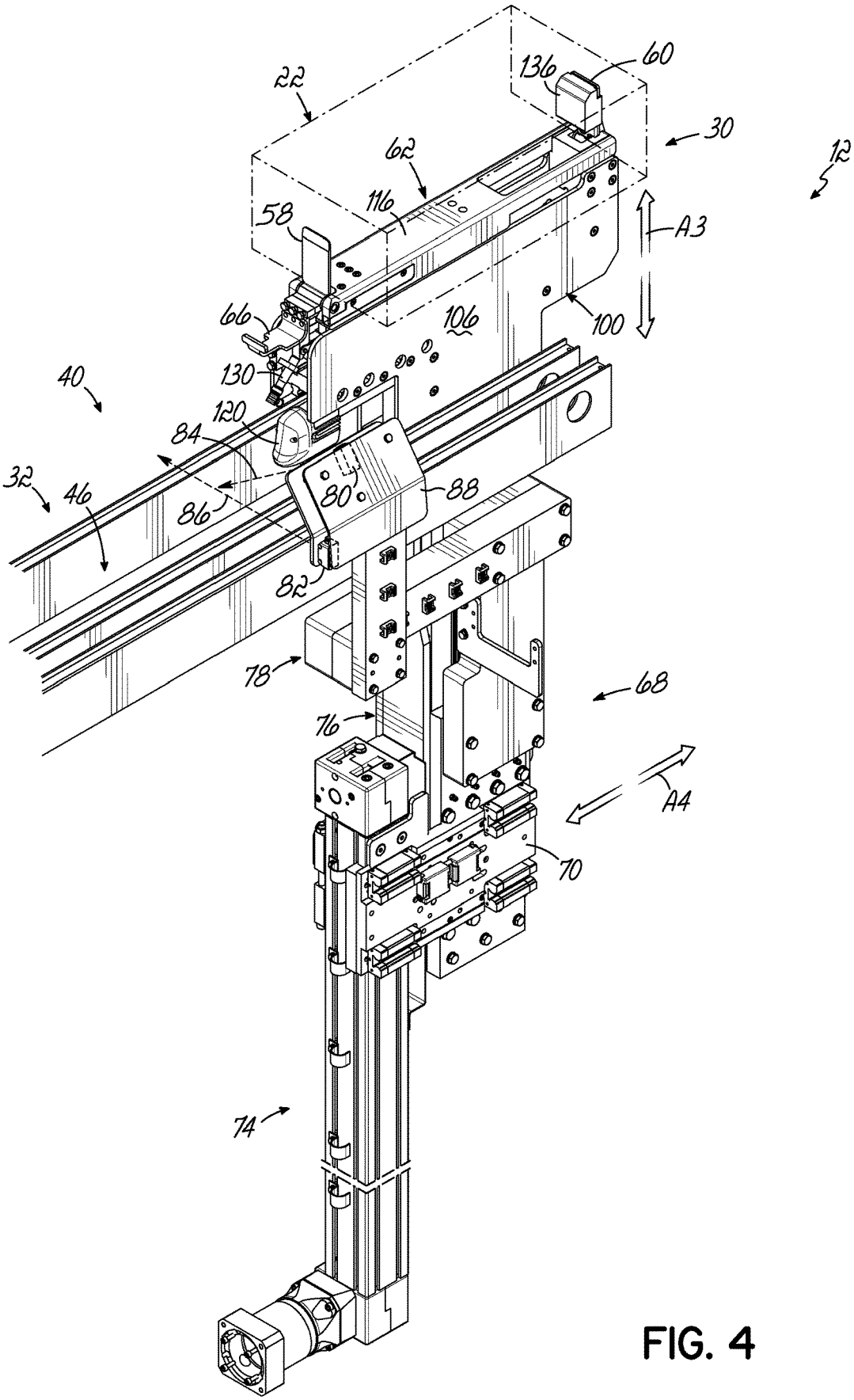
FIG. 4 is a perspective view of the linear carton handling system of FIG. 1, illustrating two axes of motion of a carton handling tool of the carton handling system.
Figure 4A:
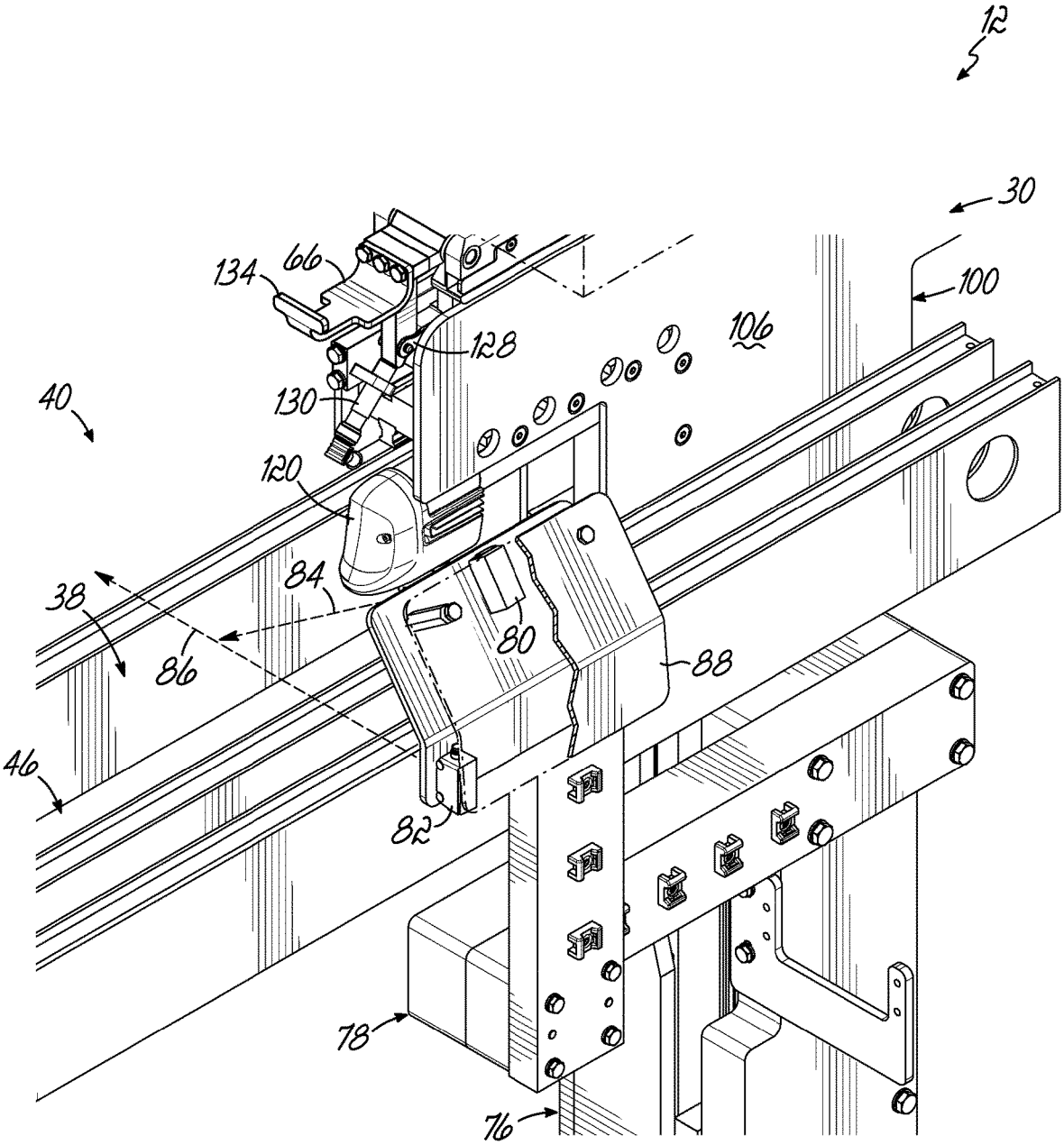
FIG. 4A is an enlarged perspective view of the carton handling tool of FIG. 4.
Figure 5:
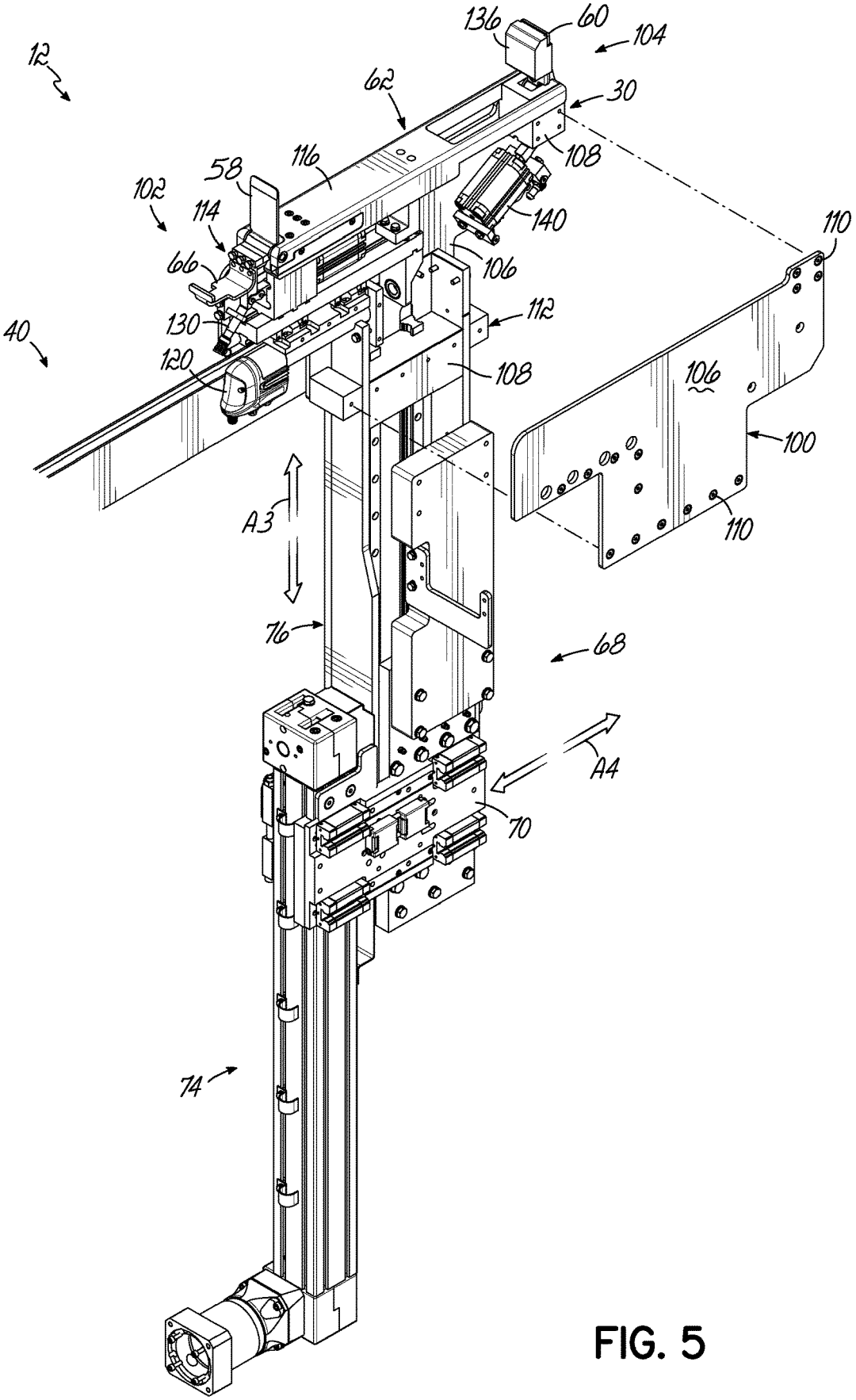
FIG. 5 is a view similar to FIG. 4, illustrating additional details of the carton handling tool.

Referring now to FIGS. 4, 4A and 5, the carton handling system 12 is configured to move the carton handling tool 30 simultaneously in two axes of motion to retrieve the slug 22 of carton blanks 24 from the material handling robot 26 and to position the slug 22 of carton blanks 24 in the magazine 32 in the manner described above. In this regard, the carton handling system 12 includes a carriage assembly 68 having a carriage 70 configured to engage with and move along a horizontal linear guide rail 72 (FIG. 8A) for moving the carriage assembly 68 in the second movement direction A4. The carriage 70 supports a vertical linear guide rail 74 to which a support arm 76 for the carton handling tool 30 is operatively coupled. In this regard, the carton handling tool 30 is attached to one end of the support arm 76 with the opposite end of the support arm 76 being configured to be driven along a length of the vertical guide rail 74 in the first movement direction A3. Movement of the carriage 70 along the horizontal guide rail 72 moves the entire carriage assembly 68 in the second movement direction A4, however, movement of the support arm 76 along the vertical guide rail 74 only moves the carton handling tool 30 in the first movement direction A3. To this end, the carriage 70 may be driven along the horizontal guide 72 with a servo motor and belt configuration, a belt and sprocket configuration, or a lead screw, for example. Similarly, the support arm 76 may be driven along the vertical guide 74 with a servo motor and belt configuration, a belt and sprocket configuration, or a lead screw, for example.

The horizontal guide rail 72 is located below the plane of advancing carton blanks 24 moving along the horizontal magazine 32 and is configured to align the carriage 70 below the envelope 46 at the receiving end 40 of the magazine 32 to position the carton handling tool 30 within the envelope 46 (e.g., FIG. 8A). In this regard, movement of the carriage 70 along the horizontal guide rail 72 permits movement of the carton handling tool 30 within the envelope 46. As described in further detail below, movement of the carton handling tool 30 along the second movement axis A4 and within the envelope 46 enables the carton handling tool 30 to "chase the tail" of the advancing stack of cartons 36 in the magazine 32 so as to place the slug 22 of carton blanks 24 at the endmost blank 34 in the advancing stack of cartons 36. To this end, the second movement axis A4 of the carton handling tool 30 is generally codirectional with a movement axis of the advancing stack of cartons 36 in the magazine 32.

With reference to FIGS. 4, 4A and 5, the vertical guide rail 74 is also located below the magazine 32 and is in a parallel relationship with the support arm 76 of the carton handling tool 30 to thereby position the carton handling tool 30 within the envelope 46 at the receiving end 40 of the magazine 32. In this regard, movement of the support arm 76 along the vertical guide rail 74 moves the carton handling tool 30 in to or out from the envelope 46 (e.g., extending from the envelop 46 or retracting into the envelope 46). More particularly, movement of the carton handling tool 30 along the first movement axis A3 enables the carton handling tool 30 to extend upwardly to the material handling device 20 to receive the slug 22 of carton blanks 24, as described above.

With continued reference to FIGS. 4, 4A and 5, the carton handling system 12 includes a sensor arm 78 configured to locate a first sensor 80 and a second sensor 82 over the horizontal magazine 32. More particularly, the sensor arm 78 is configured to locate the first and second sensors 80, 82 over the throat 38 of the magazine 32 to place the throat 38 and the advancing stack of cartons 36 within a view area 84, 86 of the first and second sensors 80, 82, respectively. The sensor arm 78 is coupled at one end to the carriage 70 of the carriage assembly 68 and extends to an opposite end where a bracket assembly 88 for supporting the first and second sensors 80, 82 is located. As the sensor arm 78 is coupled to the carriage 70, the sensor arm 78 is only moved in the second movement axis A4 with the carriage 70. Thus, the sensor arm 78 does not move in the first movement axis A3 with the carton handling tool 30. That way, the magazine 32 throat 38 and advancing stack of cartons 36 remains within the view areas 84, 86 of the first and second sensors 80, 82. In one embodiment, the sensor arm 78 may be independently moveably in the second movement axis A4. In any event, the bracket assembly 88 may be angled to position the magazine 32 throat 38 and the advancing stack of cartons 36 within the view areas 84, 86 of the first and second sensors 80. The first sensor 80 is configured to detect a fallen carton blank 64 at the end of the advancing stack of cartons 36 and the second sensor 82 is configured to detect an endmost carton blank 34 in the advancing stack of cartons 36.

Figure 6:
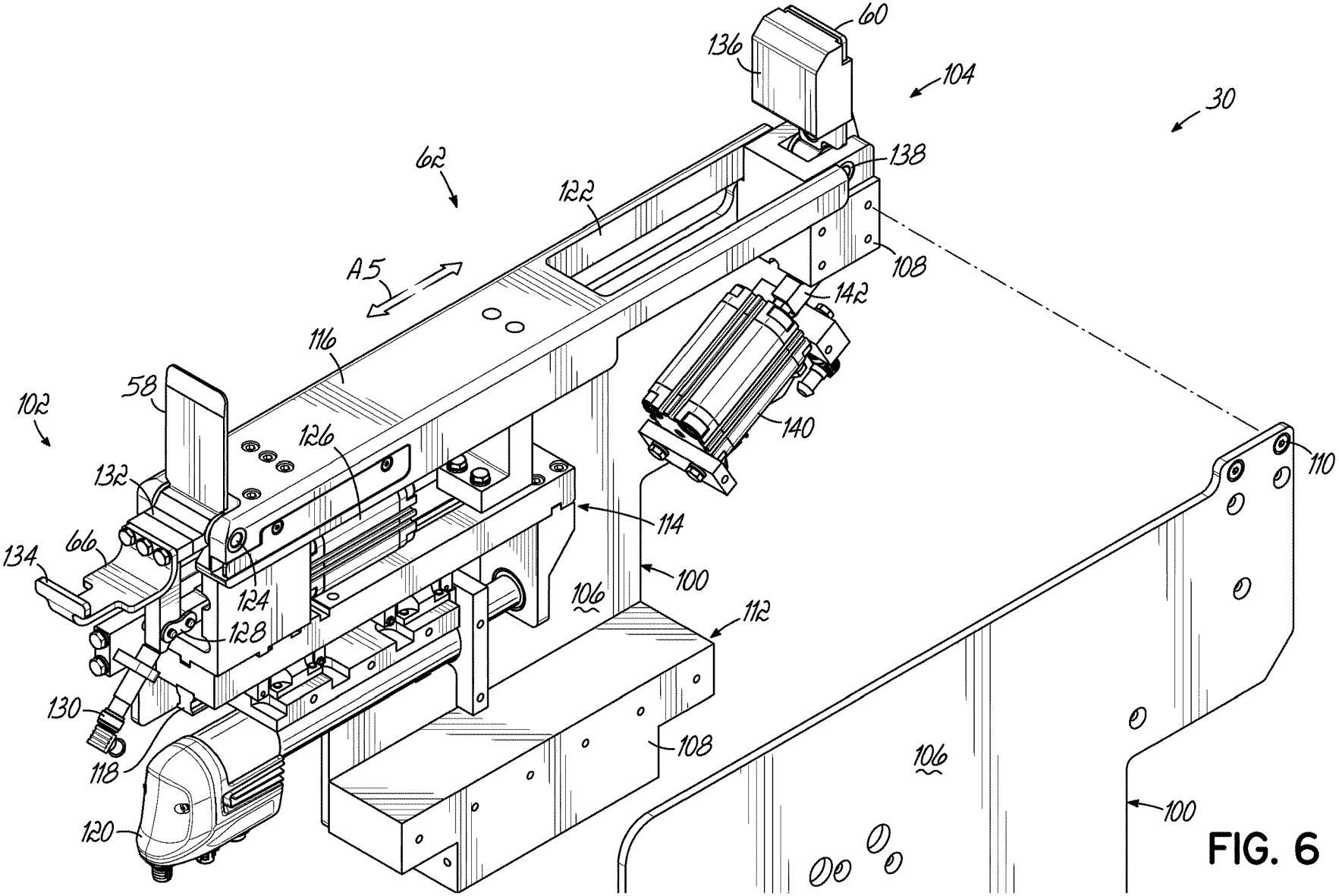
FIG. 6 is an enlarged perspective view the carton handling tool shown in FIG. 4, illustrating lateral movement of a slide assembly.

With reference to FIGS. 5 and 6, details of the carton handling tool 30 are shown and will now be described. The carton handling tool 30 includes a housing 100 which extends between a front end 102 and a back end 104 of the carton handling tool 30. The housing 100 is defined by a pair of side plates 106 which are coupled together in a spaced apart relationship to define an interior of the housing 100. In this regard, the side plates 106 are coupled together via one or more cross-members 108 and suitable fasteners 110, such as screws or bolts, for example. The cross-members 108 are configured to space the side plates 106 apart. As shown, one cross-member 108 is located at a base 112 of the housing 100 and is configured to attach the carton handling tool 30 to the support arm 76. The carton handling tool 30 further includes a slide assembly 114 that is slideably coupled to the housing 100 to permit lateral movement of the slide assembly 114 relative to the housing 100. The slide assembly 114 is located at the front end 102 of the carton handling tool 30 and includes a blank support plate 116 located at the operative end 62 of the carton handling tool 30. More particularly, the blank support plate 116 extends between the front end 102 and the back end 104 of the housing 100. The blank support plate 116 is configured to engage with the slug 22 of carton blanks 24 when received by the carton handling tool 30, as described in further detail below.

The slide assembly 114 is slideably coupled to the housing 100 via a slide rail 118. As shown, the slide rail 118 is coupled between the side plates 106 and disposed generally within the interior of the housing 100. In this regard, the slide rail 118 supports the slide assembly 114 in a floating arrangement between the two sidewalls 106. The slide assembly 114 is movable laterally (e.g., in a movement direction that is along the second movement axis A4 of the carton handling system 30) relative to the housing 100 with a linear actuator 120, as indicated by directional arrows A5. The linear actuator 120 may be a hydraulic, pneumatic, or electro-mechanical actuator. In any event, the blank support plate 116 includes a notch 122 to accommodate lateral movement of the slide assembly 114 by the actuator 120. The notch 122 is configured to receive the cross-member 108 to which the second compression jaw 60 is operatively coupled therein as the slide assembly 114 is moved in a direction A5 toward the second compression jaw 60. Movement of the slide assembly 114 in this direction A5 decreases the size, or length, of the operative end 62 and may be used to compress a slug 22 of carton blanks 24 between the first and second compression jaws 58, 60. To this end, the linear actuator 120 may be configured to measure a compression force and/or resistance of the slug 22 of carton blanks 24 to the compressive force applied by the actuator 120.

As shown in FIG. 6, the operative end 62 of the carton handling tool 30 includes the first compression jaw 58 and the second compression jaw 60 which are spaced apart from each other along a length of the operative end 62. The first compression jaw 58 is located at the front end 102 of the carton handling tool 30 and pivotably mounted on the slide 114. More particularly, the first compression jaw 58 is coupled to the blank support plate 116 with a pin 124 that defines a pivot axis of the first compression jaw 58. The pivot axis is perpendicular to the movement axes A3, A4 of the carton handling tool 30. The first compression jaw 58 is operatively connected to a linear actuator 126 via a series of linkages 128 so as to be pivotable about the pivot axis by the linear actuator 126. As shown in FIG. 6, the first compression jaw 58 is in an upright, unpivoted position. Pivotal movement of the first compression jaw 58 from the upright position is in a direction toward front end 102 of the carton handling tool 30. The carton handling tool 30 may include at least one proximity sensor 130 to detect a pivotal position of the first compression jaw 58.

The first compression jaw 58 further includes a protrusion 132 to which the blank lifting finger 66 is attached. The protrusion 132 extends from the first compression jaw 58 and front end 102 of the carton handling tool 30. As shown, the lifting finger 66 and first compression jaw 58 are in an L-shaped configuration. In this regard, the finger 66 and first compression jaw 58 share the same pivot axis defined by the pin 124 such that as the first compression jaw 58 is pivoted about the pivot axis so too is the finger 66. The finger 66 comprises a generally U-shaped bracket having a tip 134 configured to engage with a fallen carton blank 64 to lift the fallen carton blank 64 against a preceding carton blank at the end of the advancing stack of cartons 36, as described in further detail below. In one embodiment, the finger 66 may be fixed to the slide assembly 114 so as to not pivot with first compression jaw 58. Alternatively, the finger 66 may be fixed to the front end 102 of the carton handling device 30, such as to the frame 100, for example.

The second compression jaw 60 is located at the back end 104 of the carton handling tool 30 and is pivotably mounted to a cross-member 108 of the carton handling tool 30. The second compression jaw 60 may have a gripping pad 136 to facilitate engagement between the compression jaw 60 and the slug 22 of carton blanks 24, for example. As shown, the second compression jaw 60 is coupled to the cross-member 108 with a pin 138 that defines a pivot axis of the second compression jaw 60. The second compression jaw 60 is operatively connected to a linear actuator 140 via a series of linkages 142 so as to be pivotable about the pivot axis, or pin 138, by the linear actuator 140. As shown in FIG. 6, the second compression jaw 60 is in an upright, unpivoted position. Pivotal movement of the second compression jaw 60 from the upright position is in a direction toward front end 102 of the carton handling tool 30. However, in an alternative embodiment, the second compression jaw 60 may be fixedly attached to the cross-member 108 so as to be fixed in the upright position.

Figure 7A:
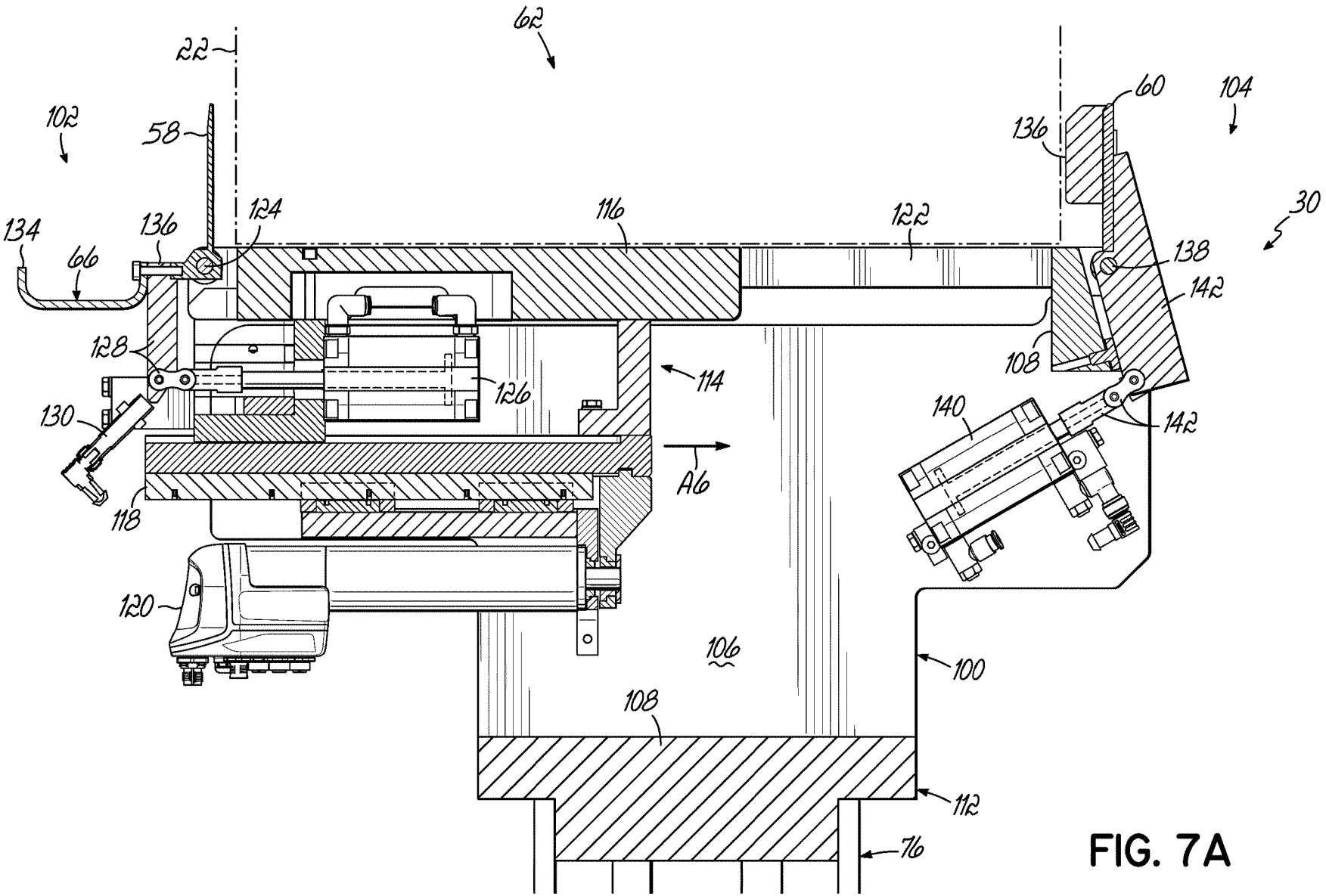
FIGS. 7A-7C are cross-sectional side views of the carton handling tool shown in FIG. 4, illustrating pivotal movement of first and second compression jaws of the carton handling tool according to one embodiment of the invention.
Figure 7B:
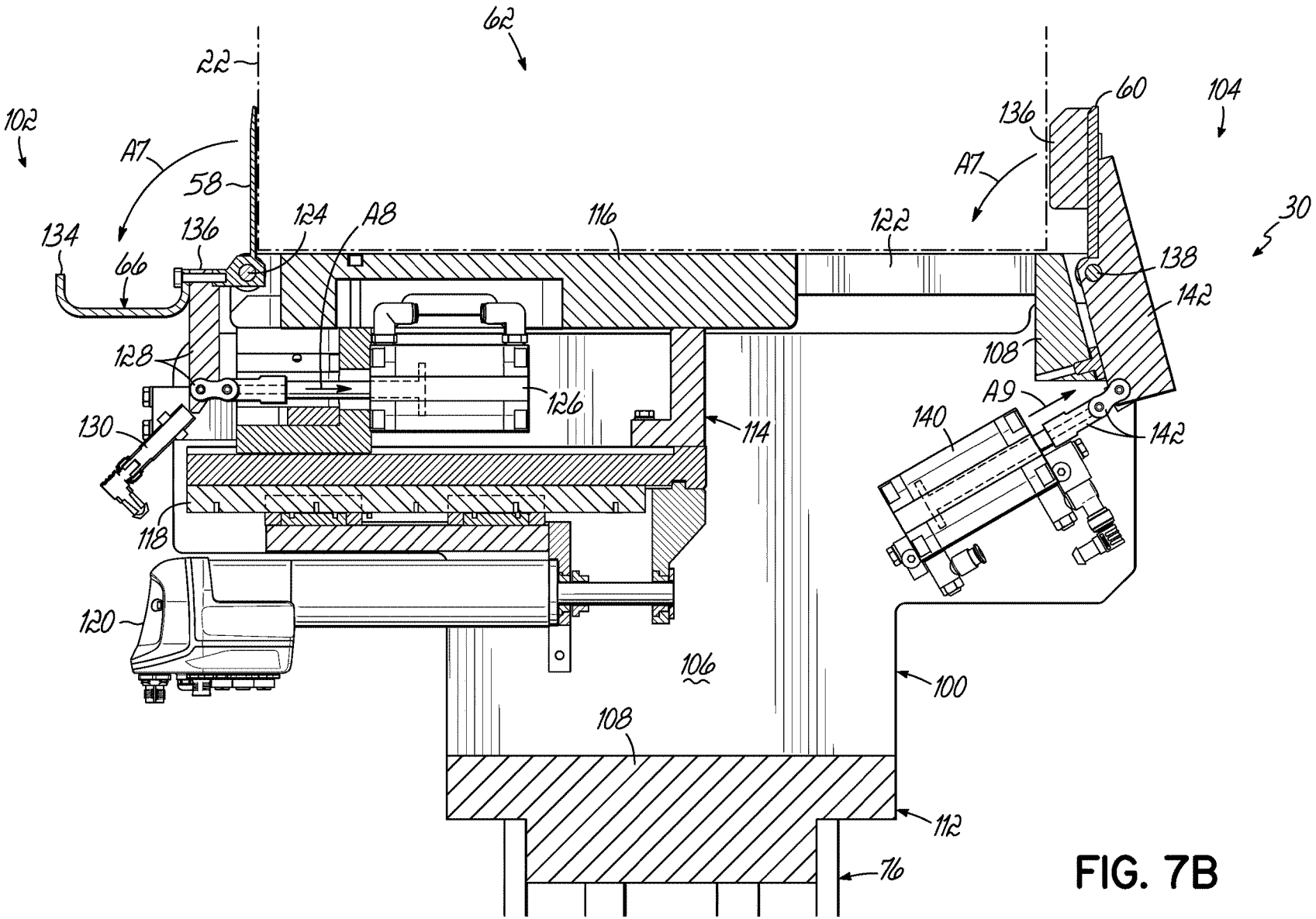
Figure 7C:
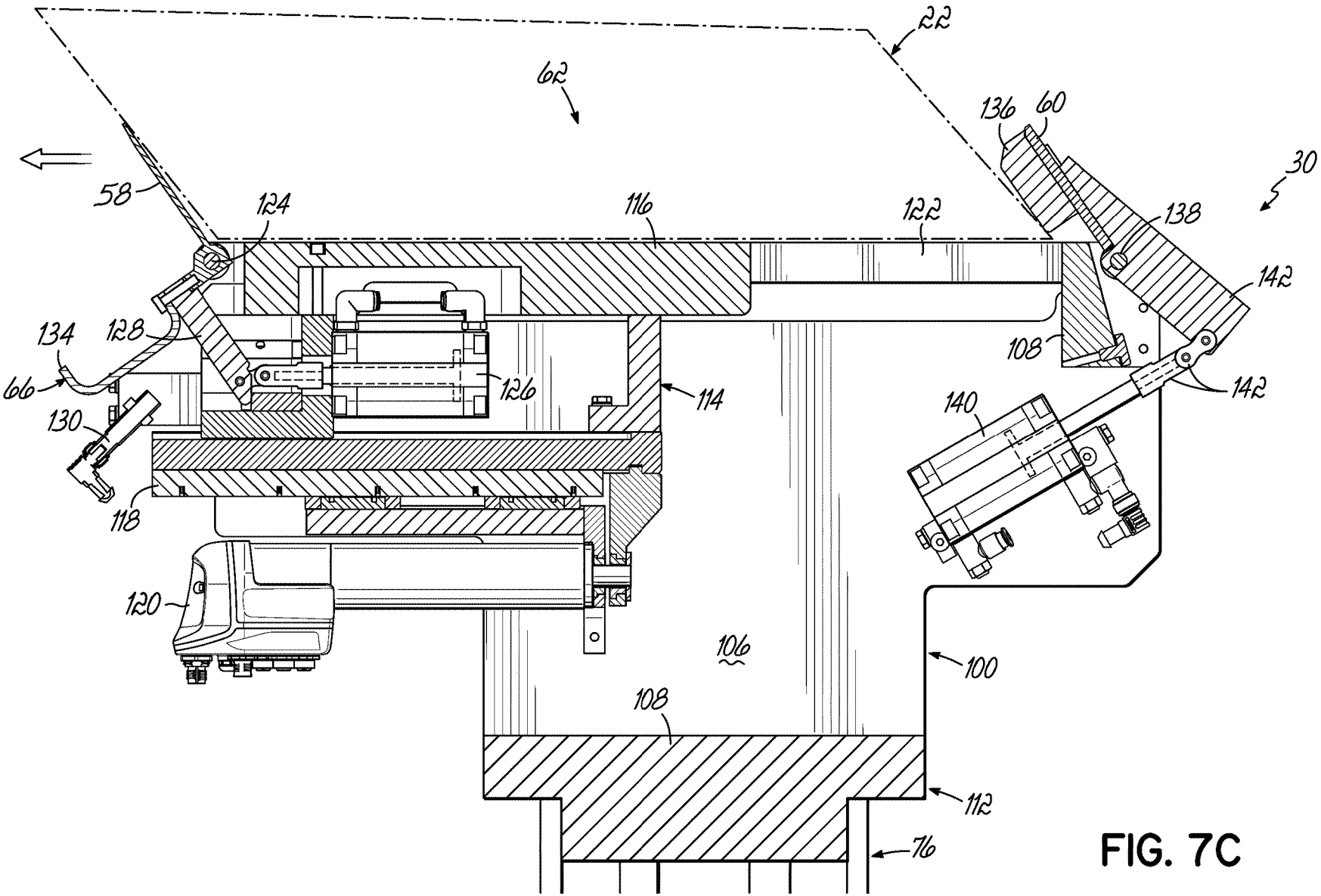

With reference to FIGS. 7A-7C, operation of the carton handling tool 30, and more particularly the first and second compression jaws 58, 60, to condition the slug 22 of carton blanks 24 retrieved by the carton handling tool 30, will now be described in detail. As shown in FIG. 7A, the operative end 62 of the carton handling tool 30 is engaged with a slug 22 of carton blanks 24 to place the slug 22 of carton blanks 24 between the first compression jaw 58 and second compression jaw 60, and the slug 22 of carton blanks 24 such that the slug 22 is in contact with the blank support plate 116. This movement is configured to tamp the slug 22 of carton blanks 24 to ensure that the upper edges and lower edges of each carton blank 24 are aligned, as described above with respect to FIG. 3B. Once the slug 22 of carton blanks 24 has been tamped, or during the tamping process, the slide assembly 114 is moved in the direction of arrow A6 to compress the slug 22 of carton blanks 24 for handling and conditioning. FIG. 7B illustrates the slug 22 of carton blanks 24 in a compressed state with the first and second compression jaws 58, 60 engaged with ends of the slug 22 of carton blanks 24. When the slug 22 of carton blanks 24 is compressed, the carton handling tool 30 is able to remove the slug 22 of carton blanks 24 from the master case 18 and gently lower the slug 22 of carton blanks 24 down to the horizontal magazine 32, as described in further detail below.

FIG. 7B illustrates the pivotal movement of the first and second compression jaws 58, 60 to provide the slug 22 of carton blanks 24 with the desired parallelogram shape with the carton blanks 24 having a desired lean, or inclination. In this regard, the first and second compression jaws 58, 60 are configured to simultaneously pivot, in a direction toward the front end 102 of the carton handling tool 30, as indicated by directional arrows A7, to tilt the upper edges of each carton blank 24 in the slug 22 forward relative to their respective lower edges. Pivotal movement of the first and second jaws 58, 60 is caused by movement of the linear actuators 126, 140, as indicated by directional arrows A8 and A9, respectively. To this end, the first and second jaws 58, 60 may pivot with a range of between 2° to 60° from their upright, or vertical position. In the embodiment shown, the first and second jaws 58, 60 are configured to pivot 30° from upright, however, this may vary based on the type of carton blanks 24 being handled. FIG. 7C illustrates the slug 22 of carton blanks 24 held by the carton handling tool 30 and having a desired lean angle. To this end, FIG. 7C illustrates a conditioned slug 22 of carton blanks 24 that is ready to be positioned in the horizontal magazine 32.

Figure 8A:
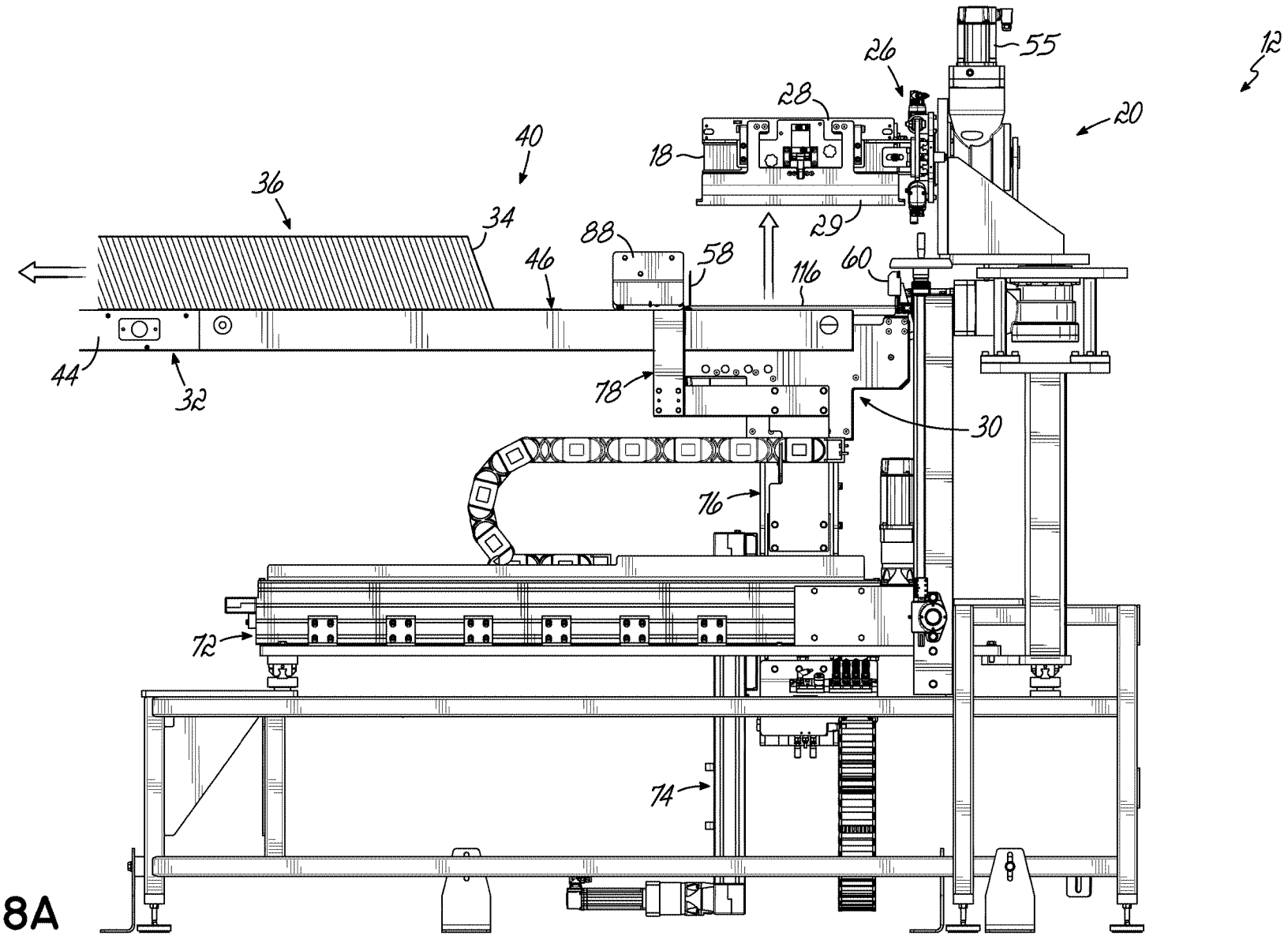
FIG. 8A is a cross-sectional side view of the carton handling system and a horizontal magazine, illustrating the carton handling tool in the process of retrieving a slug of carton blanks from the material handling device.
Figure 8B:
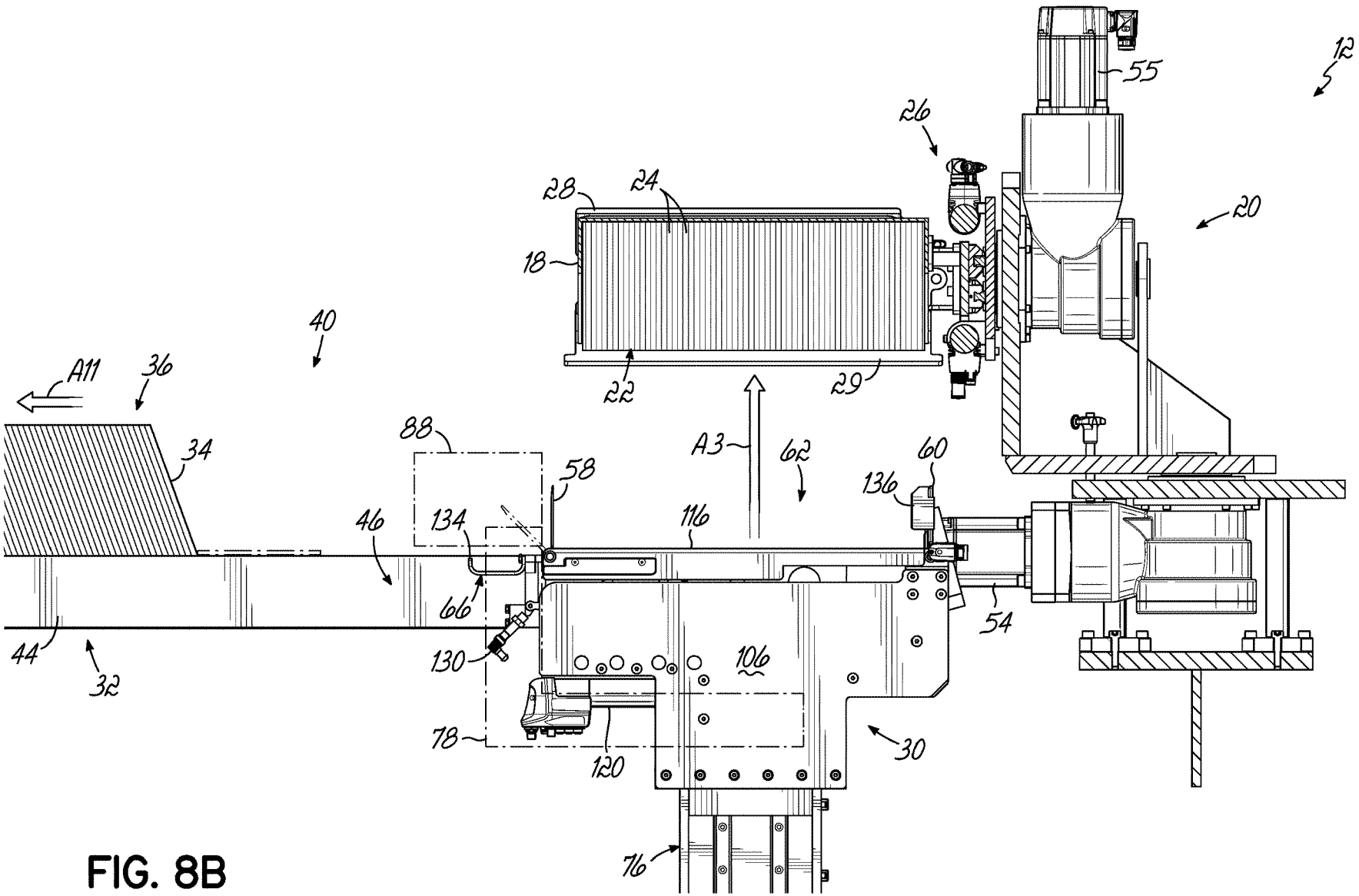
FIG. 8B is an enlarged cross-sectional side view of the carton handling system and the horizontal magazine, further illustrating the carton handling tool in the process of retrieving a slug of carton blanks from the material handling device.

With reference to FIGS. 8A-8E, an automated method of retrieving a slug 22 of carton blanks 24, conditioning the slug 22 of carton blanks 24, and loading the slug 22 of carton blanks 24 in the connected horizontal magazine 32 using the carton handling tool 30 will now be described. This process may be referred to as a magazine loading cycle. In this regard, FIG. 8A illustrates the robotic device 26 holding an inverted master case 18 containing a slug 22 of carton blanks 24 over the carton handling system 12. The robotic device 26 moves the master case 18 to the position shown in the manner described above with respect to FIGS. 3A-3B, for example. As shown in FIG. 8A, the carton handling tool 30 is in a home position within the envelope 46 of the horizontal magazine 32. From the home position, the carton handling tool 30 is configured to move in an upward direction in the first movement axis A3 and toward the master case 18 to engage the slug 22 of carton blanks 24. While moving toward the master case 18, or before, the carton handling tool 30 is configured to laterally adjust the slide assembly 114 to accommodate for the size (e.g., a length) of the slug 22 of carton blanks 24. Further, as shown schematically in FIG. 8B, the first compression jaw 58 may be in a pivoted position as the operative end 62 of the carton handling tool 30 is moved toward the slug 22 of carton blanks 24.

Figure 8C:
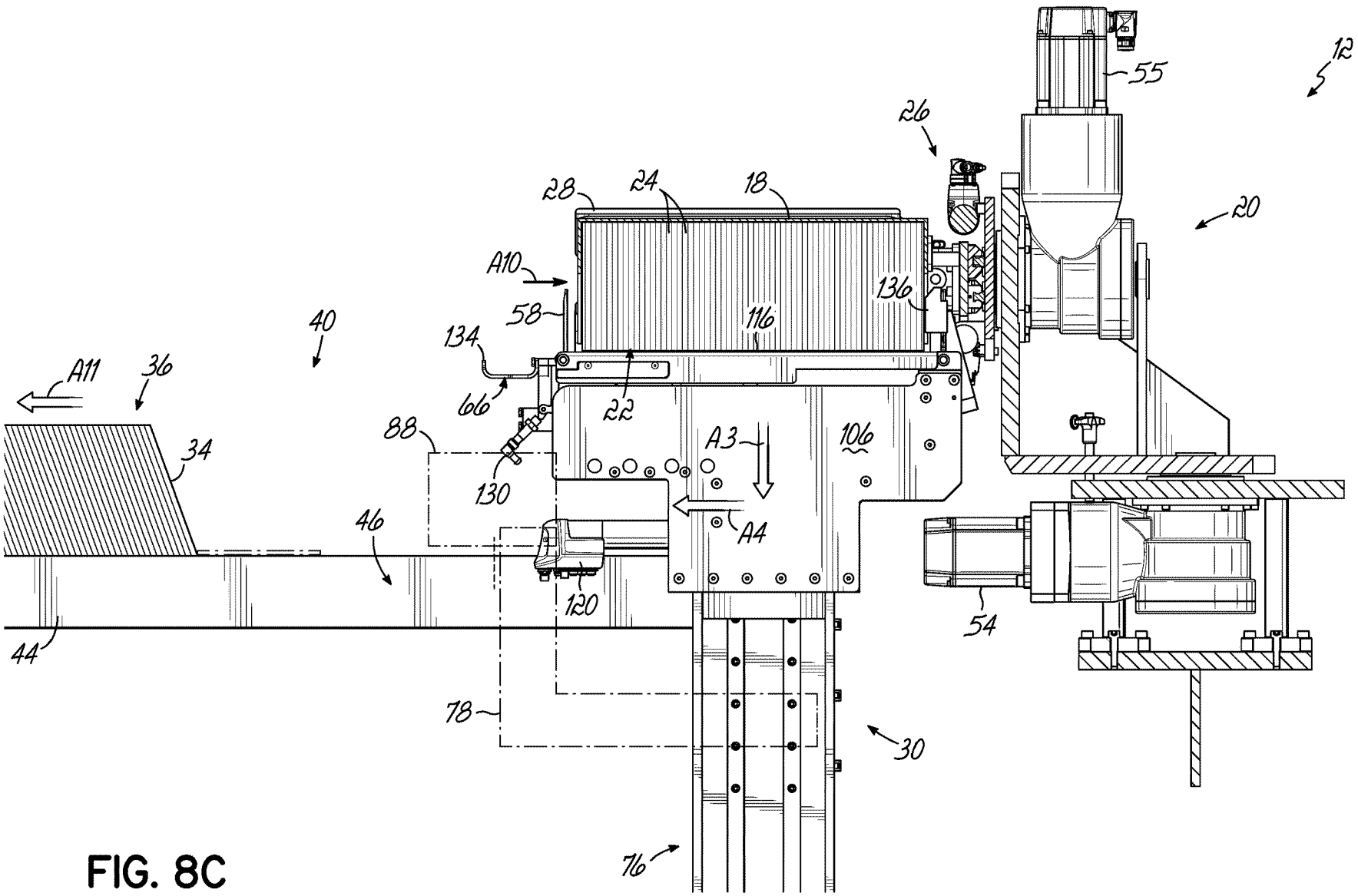
FIG. 8C is a view similar to FIG. 7B, further illustrating the carton handling tool retrieving a slug of carton blanks from the material handling device.
Figure 8D:
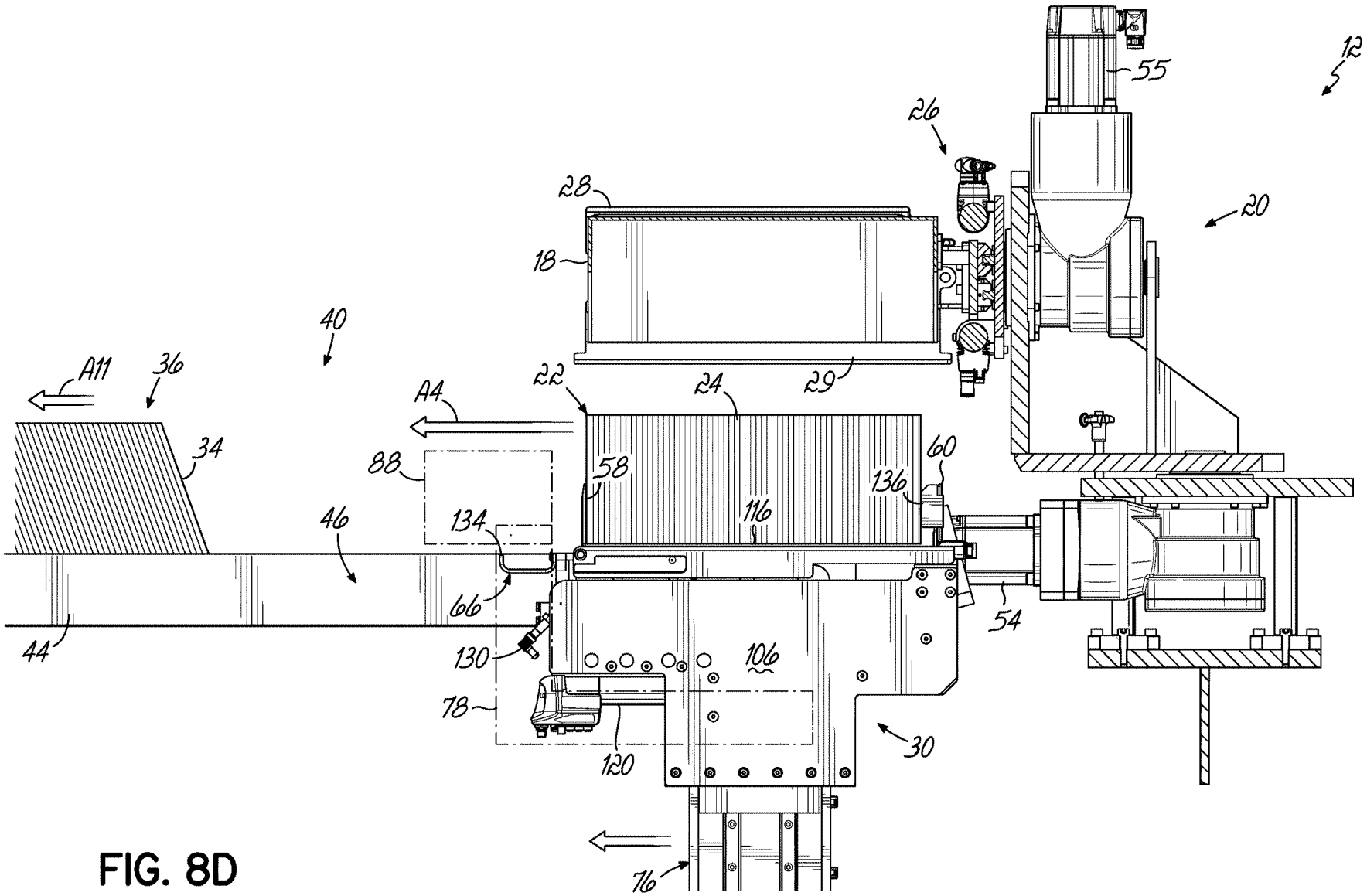
FIG. 8D is a view similar to FIGS. 7B and 7C, illustrating the carton handling tool moving to position the retrieved slug of carton blanks in the horizontal magazine.

Once the operative end 62, and more particularly the blank support plate 116, is engaged with the slug 22 of carton blanks 24, and the slug 22 of carton blanks 24 has been tamped, the first compression jaw 58 is pivoted back to upright, as shown in FIG. 8C. With continued reference to FIG. 8C, the slide assembly 114 moves in the direction of arrow A10 to compress the slug 22 of carton blanks 24 between the first and second compression jaws 58, 60 to then remove the slug 22 of carton blanks 24 from the master case 18. The carton handling tool 30 moves downward in the first movement axis A3 to remove the slug 22 of carton blanks 24 from the master case 18. The carton handling tool 30 continues to move downward to the home position to place the slug 22 of carton blanks 24 in line with the plane of carton movement along the horizontal magazine 32, as shown in FIG. 8D. When so positioned, the slug 22 of carton blanks 24 has being held against inclination and generally has no lean. In this regard, the first and second compression jaws 58, 60 hold the slug 22 of carton blanks 24 against inclination.

Figure 8E:
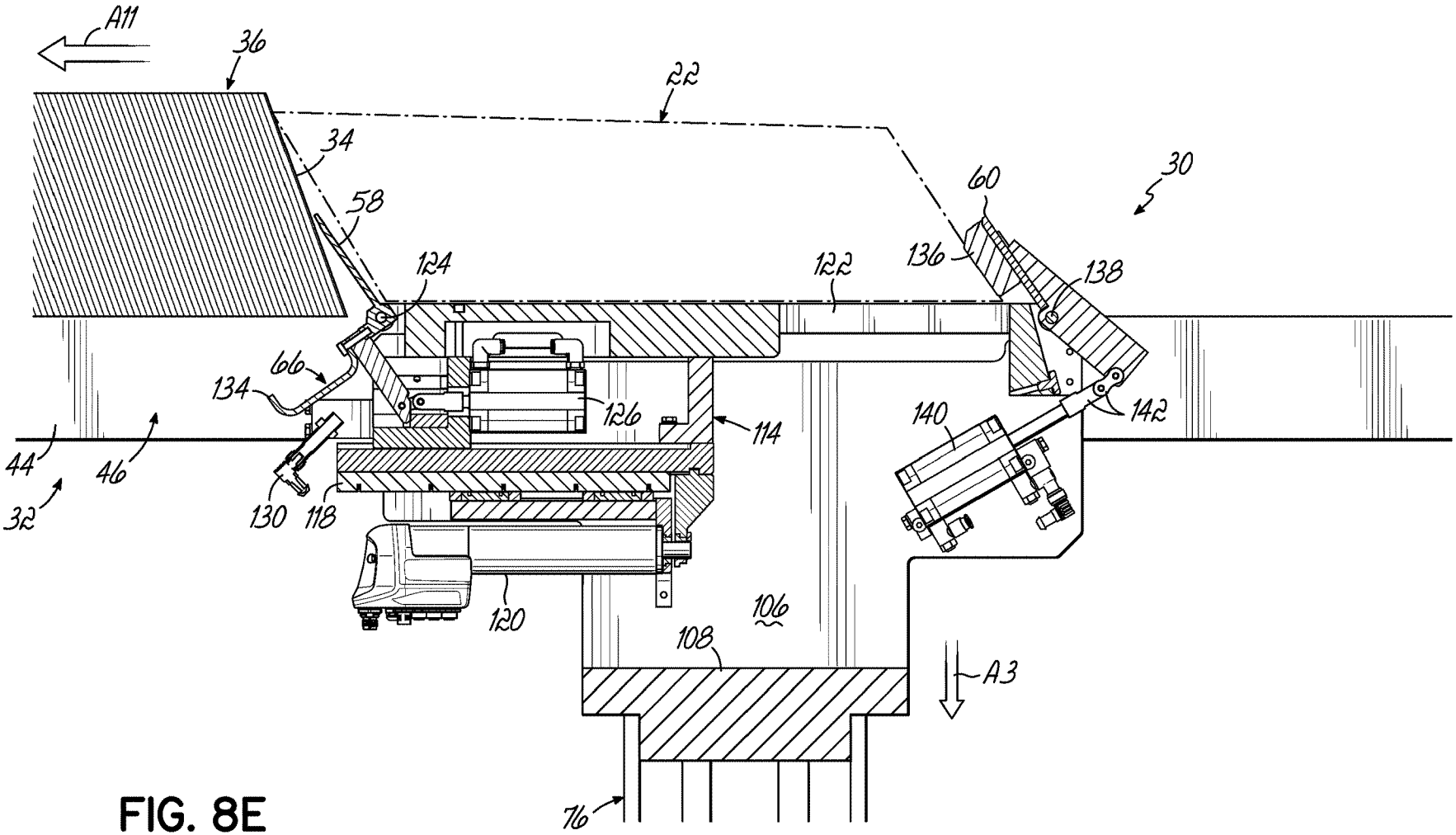
FIG. 8E is a cross-sectional side view of the carton handling tool placing the slug of carton blanks against an endmost blank in an advancing stack of carton blanks in the horizontal magazine.

With continued reference to FIG. 8D, the carton handling tool 30 is moved in the second movement axis A4 to advance the slug 22 of carton blanks 24 toward the magazine 32, and more particularly, toward the endmost blank 34 in the advancing stack of blanks 36 which is being advanced away from the carton handling tool 30 by the horizontal magazine 32, as indicated by directional arrow A11. When the carton handling tool 30 meets, or catches up with the endmost blank 34 in the advancing stack of blanks 36, which is detected by the second sensor 82, the carton handling tool 30 operates the first and second compression jaws 58, 60 to tilt the slug 22, as shown in FIG. 8E. In this regard, the desired lean of the slug 22 is achieved via simultaneous pivoting motion of the first and second compression jaws 58, 60 in the manner described above with respect to FIGS. 7A-7C. To this end, the stored energy released from the compressed slug 22 of carton blanks 24 along with the pivoting motion of the compression jaws 58, 60 produces the desired tilt of the slug 22 of carton blanks 22.

In one embodiment, during the operation illustrated in FIGS. 8D-8E, the carton handling tool 30 is configured to determine, using the second sensor 82, the exact position of the endmost carton blank 34 and to then move to a predetermined distance away from the endmost carton blank 34 to take a first distance measurement to the endmost carton blank 34. Assuming the first sensor 80 has not detected a fallen carton 64, the carton handling tool 30 lowers down a small distance to take a second distance measurement to the endmost carton blank 34. With the two distance measurements the angle of the endmost carton 34 is determined. Based on the calculated angle and the programmed set points, the carton handling tool 30 will adjust its positioning relative to the stack of cartons 36 (e.g., move toward the stack of cartons 36 on the magazine 32 or stop slight short) as well as adjust the angle of the slug 22 of carton blanks 24 being held by the carton handling tool 30 to match or otherwise accommodate for the measured lean of the advancing stack of cartons 36 in the magazine 32.

With continued reference to FIG. 8E, once the slug 22 of carton blanks 24 has been conditioned to have a desired lean, or inclination, the carton handling tool 30 positions the slug 22 of carton blanks 24 at the endmost carton blank 34 in the advancing stack of blanks 36, as shown. In this regard, the lean of the conditioned slug 22 of carton blanks 24 generally conforms to the lean of the advancing stack 36 of carton blanks in the horizontal magazine 32. Once the conditioned slug 22 of carton blanks 24 has been positioned in the horizontal magazine 32, the carton handling tool 30 retreats away from the slug 22 of carton blanks 24, in a downward direction along the first movement axis A3 to release the slug 22 of carton blanks 24. The carton handling tool 30 proceeds to return to the home position, as shown in FIG. 8A, to repeat the magazine 32 loading cycle described above with respect to FIGS. 8A-8E for a next slug 22 of carton blanks 24. To this end, the on-demand configuration of the AML system 10 triggers the magazine 32 loading cycle.

Figure 9A:
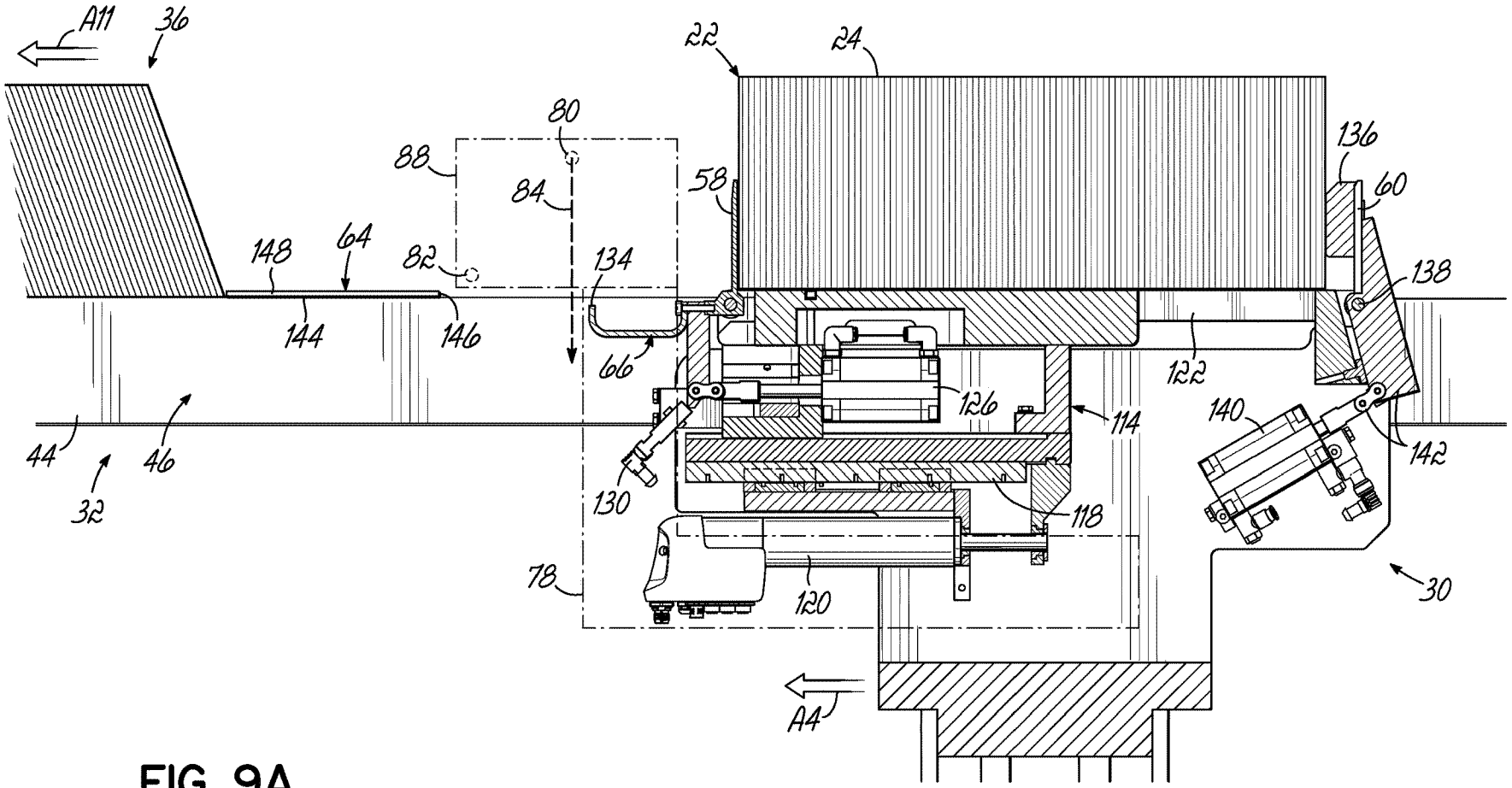
FIG. 9A is a cross-sectional side view of the carton handling system and the horizontal magazine, illustrating the carton handling tool moving to detect and upright a fallen carton blank in the horizontal magazine lane according to an embodiment of the invention.

With reference to FIGS. 9A-9D, an automated method of up-righting a fallen carton blank 64 with the carton handling tool 30 will now be described. This process may be referred to as a fallen carton blank correction cycle. The fallen carton blank correction cycle occurs after the carton handling tool 30 has retrieved the slug 22 of carton blanks 24 from the material handling device 20 (e.g., FIGS. 8A-8C described above) and before the slug 22 of carton blanks 24 is tilted to have a desired lean and placed on the horizontal magazine 32 (e.g., FIGS. 8D-8E described above). In this regard, FIG. 9A illustrates a same point in the magazine 32 loading cycle as illustrated in FIG. 8D. Thus, the fallen carton blank 64 correction cycle described below with respect to FIGS. 9A-9D is triggered if the carton handling tool 30 detects a fallen carton 64 as it is moved in the second movement axis A4 to advance the slug 22 of carton blanks 24 toward the magazine 32 which is being advanced away from the carton handling tool 30 by the horizontal magazine 32, as indicated by directional arrow A11.

Figure 9B:
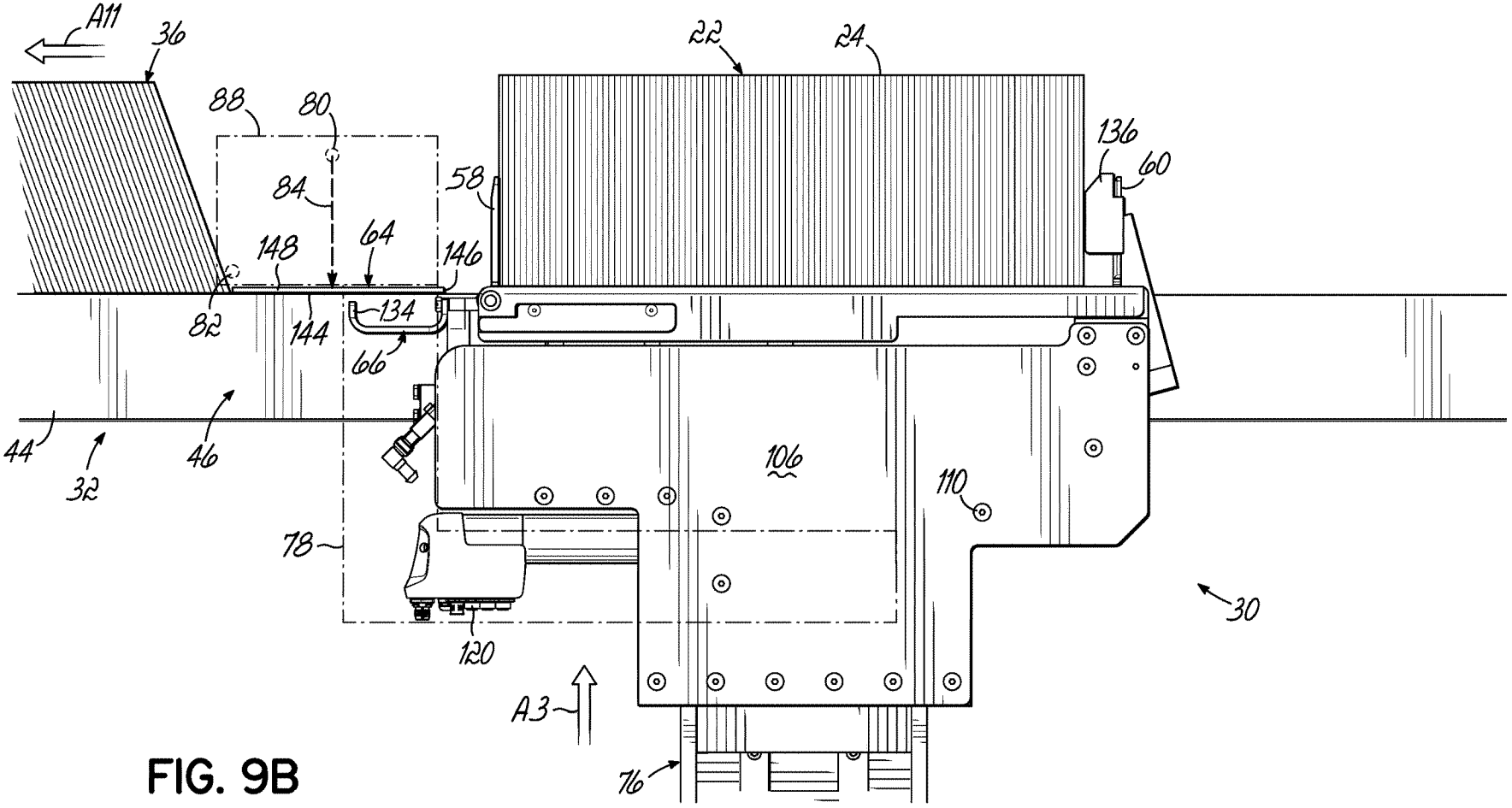
FIG. 9B is a side view of the carton handling tool and the horizontal magazine, further illustrating the carton handling tool in the process of detecting and uprighting the fallen carton blank shown in FIG. 9A.
Figure 9C:
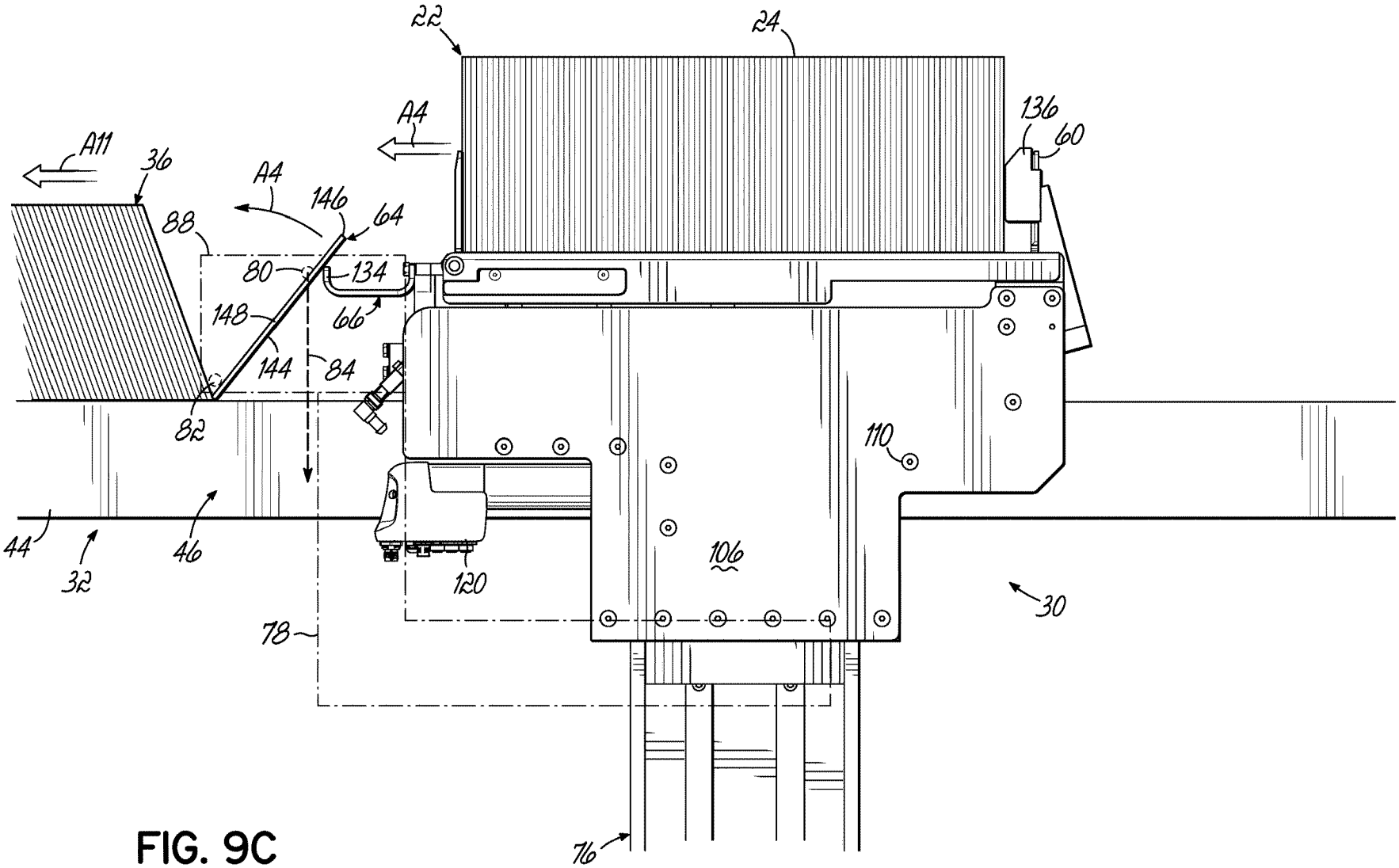
FIG. 9C is a side view similar to FIG. 9B, further illustrating the carton handling tool in the process of uprighting the fallen carton blank shown in FIG. 9A.

FIG. 9A illustrates the carton handling tool 30 moving toward the magazine 32 and the advancing stack of cartons 36. As shown, there is a fallen carton blank 64 in the magazine 32. The first sensor 80 is configured to detect the fallen carton blank 64 as the fallen carton blank 64 is moved into the view area 84 of the first sensor 80, as shown in FIG. 9B. Once the fallen carton blank 64 has been detected, movement of the carton handling tool 30 is stopped. As shown in FIG. 9B, when the carton handling tool 30 is stopped, the finger 66 is positioned so as to extend generally along a side 144 (e.g., an underside) of the fallen carton 64 to position the tip 134 of the finger 66 adjacent to the side 144 of the fallen carton blank 64. More particularly, the finger 66 is positioned along the side 144 between a midpoint and an upper edge 146 of the fallen carton blank 64. When so positioned, the carton handling tool 30 is moved in an upward direction along the first movement axis A3 to lift the upper edge 146 of the fallen carton blank 64 away from the magazine 32, as shown in FIG. 9C. As shown, the carton handling tool 30 is moved upwardly until the finger 66 nears the upper edge 146 of the fallen carton 64. When so positioned, side edges 148 of the fallen carton 64 are angled relative to the movement plane of the magazine 32. In this regard, the angle of the fallen carton 64 relative to the movement plane of the magazine 32 may be anywhere within a range of between 30° to 60°, for example.

Figure 9D:
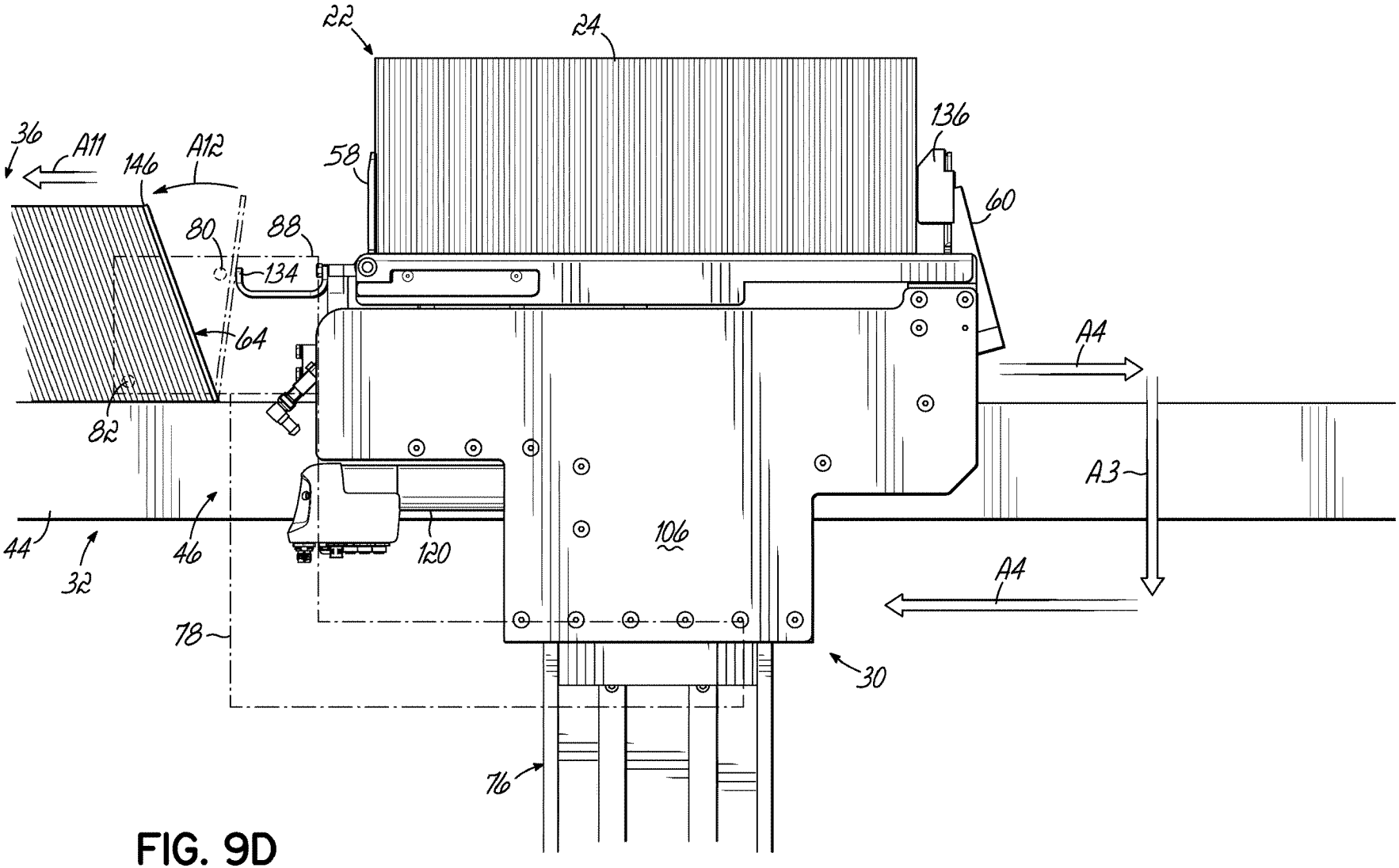
FIG. 9D is a side view similar to FIG. 9B, further illustrating the carton handling tool in the process of uprighting the fallen carton blank shown in FIG. 9A.

Once the upper edge 146 of the fallen carton blank 64 has been lifted by the finger 66, as shown in FIG. 9C, the carton handling tool 30 moves toward the advancing stack of cartons 36 in the second movement axis A4 to further lift and push the fallen carton blank 64 against a preceding blank 150 at the end of the advancing stack of blanks 36. Movement of the carton handling tool 30 in this regard generally pivots the fallen carton blank 64 against the preceding blank 150 at the end of the advancing stack of blanks 36, as shown by directional arrow A12 in FIGS. 9C and 9D. Once the fallen carton blank 64 is positioned against the preceding blank 150 at the end of the advancing stack of blanks 36, as shown in FIG. 9D, the carton handling tool 30 retreats via a combination of movements in the first movement axis A3 and the second movement axis A4 to place the slug 22 of carton blanks 24 in line with the plane of carton movement along the horizontal magazine 32 (e.g., FIG. 8D). The carton handling tool 30 then proceeds to condition and deliver the slug 22 of carton blanks 24 to the magazine 32, as described above with respect to FIGS. 8D-8E.

Figure 10:
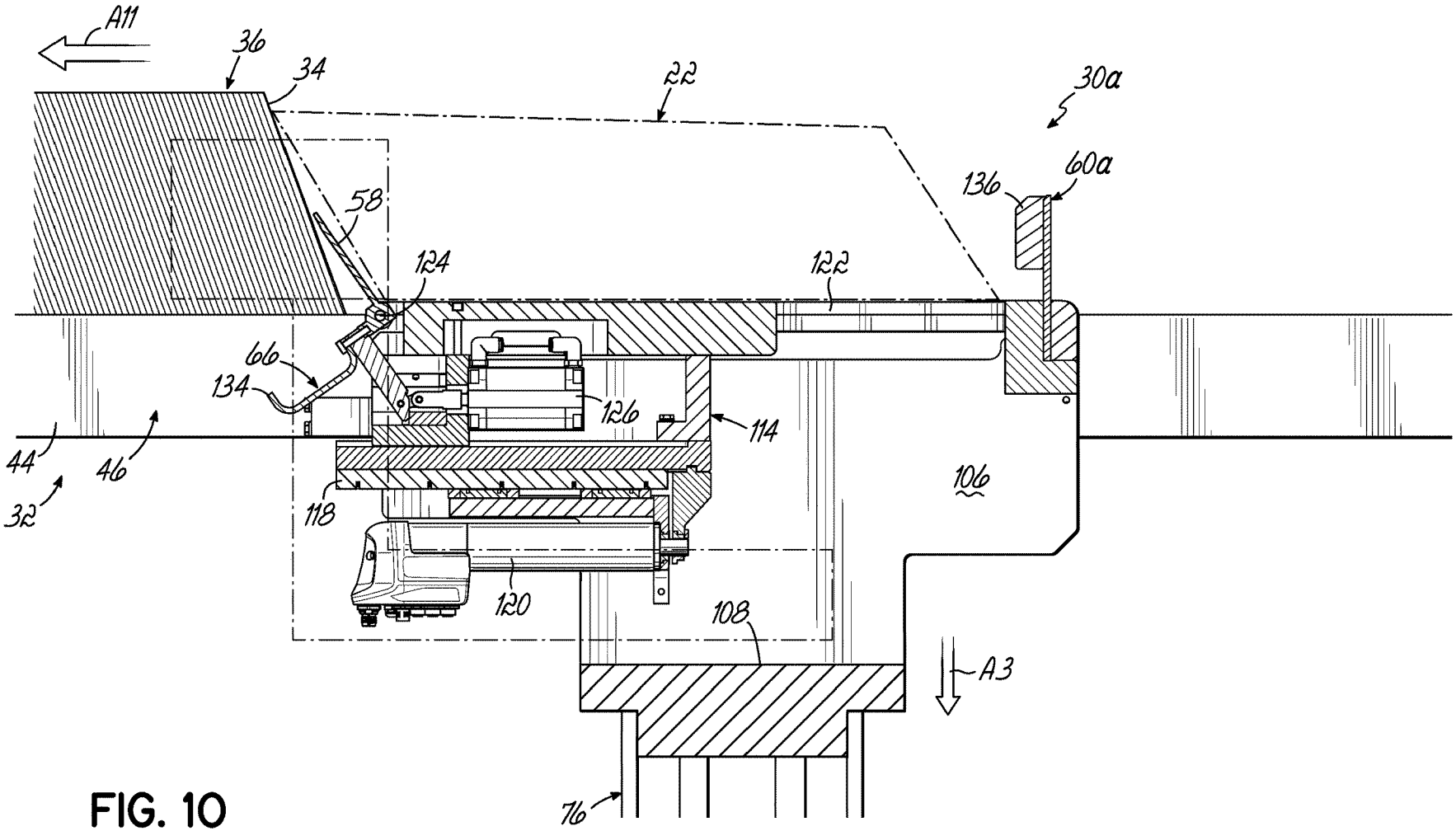
FIG. 10 is a cross-sectional side view of a carton handling tool according to another embodiment of the invention, illustrating the carton handling tool placing a slug of carton blanks against an endmost blank in an advancing stack of carton blanks in a horizontal magazine.

With reference to FIG. 10, wherein like reference numerals represent like features, details of an exemplary carton handling tool 30*a* are shown in accordance with another embodiment of the present invention. The primary differences between the carton handling tool 30*a* of this embodiment and the carton handling tool 30 of the previously described embodiment is that the carton handling tool 30*a* includes a fixed second compression jaw 60*a*. In this regard, conditioning of the slug 22 of carton blanks 24 to have a desired inclination, or lean, involves pivoting just the first compression jaw 58. To this end, the stored energy released from the compressed slug 22 of carton blanks 24, along with the pivotal movement of the first compression jaw 58, produces the desired shape of the slug 22 of carton blanks 24, as shown.

While the invention has been illustrated by the description of various embodiments thereof, and while the embodiments have been described in considerable detail, it is not intended to restrict or in any way limit the scope of the appended claims to such detail. Thus, the various features discussed herein may be used alone or in any combination. Additional advantages and modifications will readily appear to those skilled in the art. The invention in its broader aspects is therefore not limited to the specific details and illustrative examples shown and described. Accordingly, departures may be made from such details without departing from the scope of the general inventive concept.

What is claimed is:

1. A carton handling system for loading a carton blank magazine with a slug of carton blanks, comprising:

a carriage assembly having a carton handling tool, the carriage assembly being capable of moving the carton handling tool in two axes of motion to receive the slug of carton blanks and to position the slug of carton blanks in the carton blank magazine; and a finger carried on the carton handling tool, wherein the carton handling tool is movable to engage the finger with an underside of a fallen carton blank lying at an end of an advancing stack of blanks in the carton blank magazine so as to lift the fallen carton blank against a preceding blank at the end of the advancing stack of blanks, and wherein the carton handling tool is movable to position the slug of carton blanks at an endmost blank in the advancing stack of blanks.

2. The carton handling system of claim 1, wherein movement of the carton handling tool to receive the slug of carton blanks is in an upward direction relative to the carton blank magazine.

3. The carton handling system of claim 1, wherein the carton handling tool further comprises a first compression jaw and a second compression jaw spaced apart from the first compression jaw along an operative end of the carton handling tool, at least one of the first and second compression jaws being operable to engage and to hold the slug of carton blanks such that the plurality of blanks are held against inclination prior to placement of the slug of carton blanks at the endmost blank in the advancing stack of blanks.

4. The carton handling system of claim 3, wherein the finger is fixed to the first compression jaw.

5. The carton handling system of claim 1, wherein the first compression jaw is operatively connected to a slide assembly configured to laterally move the first compression jaw toward or away from the second compression jaw.

6. The carton handling system of claim 5, wherein the first compression jaw is pivotable about the slide.

7. The carton handling system of claim 6, wherein the first compression jaw is pivoted in a direction away from the second compression jaw to position each carton blank of the slug of carton blanks at an inclination prior to placement of the slug of carton blanks at the endmost blank in the advancing stack of blanks.

8. The carton handling system of claim 6, wherein the second compression jaw is pivotably mounted on the carton handling tool.

9. The carton handling system of claim 8, wherein the first compression jaw and the second compression jaw are each pivoted in a direction toward the carton blank magazine to position each blank of the slug of carton blanks at an inclination prior to placement of the slug of carton blanks at the endmost blank in the advancing stack of blanks.

10. The carton handling system of claim 5, wherein the finger is fixed to the slide assembly.

11. The carton handling system of claim 1, wherein the finger is fixed to a front end of the carton handling tool.

12. The carton handling system of claim 1, wherein the carriage includes a first sensor positioned to detect the fallen carton blank at the end of the advancing stack of blanks in the carton blank magazine.

13. The carton handling system of claim 12, wherein the carriage includes a second sensor positioned to detect the endmost blank in the advancing stack of blanks in the carton blank magazine.

14. The carton handling system of claim 1, wherein the carriage is capable of simultaneously moving the carton handling tool along a vertical axis and a horizontal axis relative to the carton blank magazine.

15. The carton handling system of claim 14, wherein the carriage is capable of moving the carton handling tool in a downward direction from the carton blank magazine along the vertical movement axis and in a rearward direction away from the carton blank magazine along the horizontal movement axis to retract the finger from a lifted fallen carton blank.

16. A method of loading a slug of carton blanks into a carton blank magazine, comprising:

providing a carton handling system having a carriage assembly including a carton handling tool, the carriage assembly capable of moving the carton handling tool in two axes of motion to receive the slug of carton blanks and to position the slug of carton blanks in the carton blank magazine, a finger carried on the carton handling tool, and at least one sensor;

receiving the slug of carton blanks by the carton handling tool;

moving the slug of carton blanks toward an end of an advancing stack of blanks in the carton blank magazine;

detecting whether a fallen carton blank carton is lying at the end of the advancing stack of blanks;

lifting the fallen carton blank against a preceding blank carton at the end of the advancing stack of blanks with the finger;

moving the slug of blanks toward the end of the advancing stack of blanks; and releasing the slug of blanks at the end of the advancing stack of blanks.

17. The method of claim 16, further comprising:

moving the carton handling tool downwardly and rearwardly away from the stack of blanks in the carton blank magazine to release the slug of blanks to a position to receive another slug of blanks.

18. The method of claim 16, further comprising:

moving the carton handling tool rearwardly away from a lifted fallen carton blank and downwardly to a position to move the slug of blanks toward the end of the advancing stack of blanks in the carton blank magazine.

19. The method of claim 16, wherein the carton handling tool further comprises a first compression jaw and a second compression jaw, the first compression jaw being pivotably mounted on the carton handling tool, the step of moving the slug of blanks toward the end of the advancing stack of blanks further comprising:

pivoting the first compression jaw to position the slug of carton blanks at an inclination prior to placement of the slug of carton blanks at the endmost blank in the advancing stack of blanks.

20. The method of claim 19, wherein the first compression jaw is operatively connected to a slide assembly configured to laterally move the first compression jaw toward and away from the second compression jaw, the step of receiving the slug of carton blanks by the carton handling tool further comprising:

moving the slide assembly to adjust a distance between the first compression jaw and the second compression jaw to receive the slug of carton blanks; and moving the slide assembly to compress the slug of carton blanks between the first compression jaw and the second compression jaw.

21. The method of claim 16, wherein the step of receiving the slug of carton blanks by the carton handling tool further comprises:

moving the carton handling tool in an upward direction relative to the carton blank magazine.

* * * * *